US009372417B2

(12) United States Patent
Fujii et al.

(10) Patent No.: US 9,372,417 B2
(45) Date of Patent: Jun. 21, 2016

(54) METHOD FOR PRODUCING ELECTROPHOTOGRAPHIC PHOTOSENSITIVE MEMBER

(71) Applicant: CANON KABUSHIKI KAISHA, Tokyo (JP)

(72) Inventors: Atsushi Fujii, Yokohama (JP); Hideaki Matsuoka, Mishima (JP); Haruyuki Tsuji, Yokohama (JP); Nobuhiro Nakamura, Numazu (JP); Kazuhisa Shida, Kawasaki (JP)

(73) Assignee: CANON KABUSHIKI KAISHA, Tokyo (JP)

( * ) Notice: Subject to any disclaimer, the term of this patent is extended or adjusted under 35 U.S.C. 154(b) by 0 days.

(21) Appl. No.: 14/396,350

(22) PCT Filed: Jun. 17, 2013

(86) PCT No.: PCT/JP2013/067150
§ 371 (c)(1),
(2) Date: Oct. 22, 2014

(87) PCT Pub. No.: WO2014/002915
PCT Pub. Date: Jan. 3, 2014

(65) Prior Publication Data

US 2015/0086921 A1 Mar. 26, 2015

(30) Foreign Application Priority Data

Jun. 29, 2012 (JP) ..... 2012-147143
Jan. 17, 2013 (JP) ..... 2013-006397

(51) Int. Cl.
*G03G 5/10* (2006.01)
*G03G 5/08* (2006.01)
(Continued)

(52) U.S. Cl.
CPC ..... *G03G 5/08* (2013.01); *G03G 5/0525* (2013.01); *G03G 5/104* (2013.01); *G03G 5/144* (2013.01)

(58) Field of Classification Search
CPC ..... G03G 5/0525; G03G 5/08; G03G 5/144
See application file for complete search history.

(56) References Cited

U.S. PATENT DOCUMENTS 6,156,472 A 12/2000 Segi et al.
7,407,606 B2 8/2008 Chiba et al.
(Continued)

FOREIGN PATENT DOCUMENTS

EP 0 977 089 A1 2/2000
JP 6-207118 A 7/1994
(Continued)

OTHER PUBLICATIONS

Translation of JP 2005-141119 published Jun. 2005.*
(Continued)

*Primary Examiner* — Peter Vajda
(74) *Attorney, Agent, or Firm* — Fitzpatrick, Cella, Harper & Scinto

(57) ABSTRACT

A method for producing an electrophotographic photosensitive member in which leakage hardly occurs is provided. For this, in the method for producing an electrophotographic photosensitive member according to the present invention, a coating liquid for a conductive layer is prepared using a solvent, a binder material, and a metallic oxide particle having a water content of not less than 1.0% by mass and not more than 2.0% by mass; using the coating liquid for a conductive layer, a conductive layer having a volume resistivity of not less than $1.0\times10^{8}$ Ω·cm and not more than $5.0\times10^{12}$ Ω·cm is formed; the mass ratio (P/B) of the metallic oxide particle (P) to the binder material (B) in the coating liquid for a conductive layer is not less than 1.5/1.0 and not more than 3.5/1.0; and the metallic oxide particle is selected from the group consisting of a titanium oxide particle coated with tin oxide doped with phosphorus, a titanium oxide particle coated with tin oxide doped with tungsten, and a titanium oxide particle coated with tin oxide doped with fluorine.

13 Claims, 3 Drawing Sheets

(51) Int. Cl.
*G03G 5/05* (2006.01)
*G03G 5/14* (2006.01)

(56) References Cited

U.S. PATENT DOCUMENTS

| | | | |
|---|---|---|---|
| 7,910,274 | B2 | 3/2011 | Tanaka et al. |
| 8,455,170 | B2 | 6/2013 | Nakamura et al. |
| 8,669,027 | B2 | 3/2014 | Anezaki et al. |
| 8,778,580 | B2 | 7/2014 | Tsuji et al. |
| 2004/0259009 | A1 | 12/2004 | Itami et al. |
| 2006/0177749 | A1 | 8/2006 | Tamoto et al. |
| 2009/0136256 | A1 | 5/2009 | Nakamura et al. |
| 2012/0114375 | A1 | 5/2012 | Fujii et al. |
| 2013/0236823 | A1 | 9/2013 | Noguchi et al. |
| 2013/0316283 | A1 | 11/2013 | Fujii et al. |
| 2014/0065529 | A1 | 3/2014 | Fujii et al. |

FOREIGN PATENT DOCUMENTS

| | | | | | |
|---|---|---|---|---|---|
| JP | 2004-349167 | A | | 12/2004 | |
| JP | 2005-141119 | | * | 6/2005 | ..... G03G 5/14 |
| JP | 2005-141119 | A | | 6/2005 | |
| JP | 2012-018370 | | * | 1/2012 | ..... G03G 5/14 |
| JP | 2012-18370 | A | | 1/2012 | |
| JP | 2012-18371 | A | | 1/2012 | |
| WO | 2005/008685 | A1 | | 1/2005 | |
| WO | 2011/027911 | A1 | | 3/2011 | |
| WO | 2011/027912 | A1 | | 3/2011 | |

OTHER PUBLICATIONS

Translation of JP 2012-018370 published Jan. 2012.*

International Preliminary Report on Patentability, International Application No. PCT/JP2013/067150, Mailing Date Jan. 8, 2015.

PCT International Search Report and Written Opinion of the International Searching Authority, International Application No. JP2013/067150, Mailing Date Sep. 10, 2013.

European Search Report dated Feb. 12, 2016 in European Application No. 13808668.1.

* cited by examiner

METHOD FOR PRODUCING ELECTROPHOTOGRAPHIC PHOTOSENSITIVE MEMBER

TECHNICAL FIELD

The present invention relates to a method for producing an electrophotographic photosensitive member.

BACKGROUND ART

Recently, research and development of electrophotographic photosensitive members (organic electrophotographic photosensitive members) using an organic photoconductive material have been performed actively.

The electrophotographic photosensitive member basically includes a support and a photosensitive layer formed on the support. Actually, however, in order to cover defects of the surface of the support, protect the photosensitive layer from electrical damage, improve charging properties, and improve charge injection prohibiting properties from the support to the photosensitive layer, a variety of layers is often provided between the support and the photosensitive layer.

Among the layers provided between the support and the photosensitive layer, as a layer provided to cover defects of the surface of the support, a layer containing metallic oxide particles is known. Usually, the layer containing metallic oxide particles has a higher conductivity than a layer containing no metallic oxide particle (for example, volume resistivity of $1.0\times10^{8}$ to $5.0\times10^{12}$ Ω·cm). Accordingly, even if the film thickness of the layer increases, residual potential hardly increases at the time of forming an image. For this reason, dark potential and bright potential hardly change. For this reason, the defects of the surface of the support are easily covered. Such a highly conductive layer (hereinafter, referred to as a "conductive layer") is provided between the support and the photosensitive layer to cover the defects of the surface of the support. Thereby, the tolerable range of the defects of the surface of the support is wider. As a result, the tolerable range of the support to be used is significantly wider, leading to an advantage in that productivity of the electrophotographic photosensitive member can be improved.

PTL 1 discloses a technique in which a titanium oxide particle coated with tin oxide doped with phosphorus, or a titanium oxide particle coated with tin oxide doped with tungsten is contained in a conductive layer provided between a support and a photosensitive layer.

Moreover, PTL 2 discloses a technique in which a titanium oxide particle coated with tin oxide doped with phosphorus, a titanium oxide particle coated with tin oxide doped with tungsten, or a titanium oxide particle coated with tin oxide doped with fluorine is contained in a conductive layer provided between a support and a photosensitive layer.

CITATION LIST

Patent Literature

PTL 1: Japanese Patent Application Laid-Open No. 2012-18371

PTL 2: Japanese Patent Application Laid-Open No. 2012-18370

SUMMARY OF INVENTION

Technical Problem

However, examination by the present inventors has revealed that if an image is repeatedly formed under a low temperature and low humidity environment using an electrophotographic photosensitive member employing the layer containing a titanium oxide particle coated with tin oxide doped with phosphorus, a titanium oxide particle coated with tin oxide doped with tungsten, or a titanium oxide particle coated with tin oxide doped with fluorine as above as a conductive layer, then leakage is likely to occur in the electrophotographic photosensitive member. The leakage refers to a phenomenon such that local portions in the electrophotographic photosensitive member break down, and excessive current flows through the local portions. When the leakage occurs, the electrophotographic photosensitive member cannot be sufficiently charged, leading to a poor image on which black dots, horizontal black streaks, and the like are formed. The horizontal black streaks refer to black streaks that manifest themselves on an output image in correspondence with the direction intersecting perpendicular to the rotational direction (circumferential direction) of the electrophotographic photosensitive member.

An object of the present invention is to provide a method for producing an electrophotographic photosensitive member in which leakage hardly occurs even if an electrophotographic photosensitive member employs a layer containing a titanium oxide particle coated with tin oxide doped with phosphorus, a titanium oxide particle coated with tin oxide doped with tungsten, or a titanium oxide particle coated with tin oxide doped with fluorine as a conductive layer.

Solution to Problem

The present invention is a method for producing an electrophotographic photosensitive member, comprising:

- a step (i) of forming a conductive layer having a volume resistivity of not less than $1.0\times10^{8}$ Ω·cm and not more than $5.0\times10^{12}$ Ω·cm on a support; and
- a step (iii) of forming a photosensitive layer on the conductive layer, wherein, the step (i) comprises:

- preparing a coating liquid for a conductive layer using a solvent, a binder material, and a metallic oxide particle having a water content of not less than 1.0% by mass and not more than 2.0% by mass, and
- forming the conductive layer using the coating liquid for a conductive layer, a mass ratio (P/B) of the metallic oxide particle (P) to the binder material (B) in the coating liquid for a conductive layer is not less than 1.5/1.0 and not more than 3.5/1.0, and the metallic oxide particle is selected from the group consisting of:

- a titanium oxide particle coated with tin oxide doped with phosphorus,
- a titanium oxide particle coated with tin oxide doped with tungsten, and
- a titanium oxide particle coated with tin oxide doped with fluorine.

Advantageous Effects of Invention

According to the present invention, a method for producing an electrophotographic photosensitive member can be provided in which leakage hardly occurs even if an electrophotographic photosensitive member employs a layer containing a titanium oxide particle coated with tin oxide doped with phosphorus, a titanium oxide particle coated with tin oxide doped with tungsten, or a titanium oxide particle coated with tin oxide doped with fluorine as a conductive layer.

Further features of the present invention will become apparent from the following description of exemplary embodiments with reference to the attached drawings.

DESCRIPTION OF EMBODIMENTS

Figure 1:
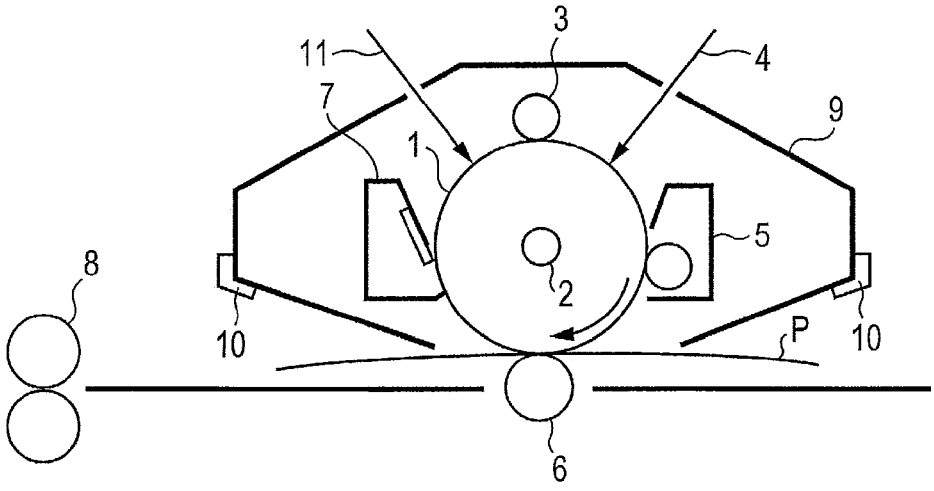
FIG. 1 is a drawing illustrating an example of a schematic configuration of an electrophotographic apparatus including a process cartridge having an electrophotographic photosensitive member.

The method for producing an electrophotographic photosensitive member according to the present invention includes: forming a conductive layer having a volume resistivity of not less than $1.0\times10^{8}$ Ω·cm and not more than $5.0\times10^{12}$ Ω·cm on a support, and forming a photosensitive layer on the conductive layer.

An electrophotographic photosensitive member produced by a production method according to the present invention (hereinafter, referred to as the "electrophotographic photosensitive member according to the present invention") is an electrophotographic photosensitive member including a support, a conductive layer formed on the support, and a photosensitive layer formed on the conductive layer. The photosensitive layer may be a single photosensitive layer in which a charge-generating substance and a charge transport substance are contained in a single layer, or a laminated photosensitive layer in which a charge-generating layer containing a charge-generating substance and a charge transport layer containing a charge transport substance are laminated. Moreover, in electrophotographic photosensitive member according to the present invention, when necessary, an undercoat layer may be provided between the conductive layer formed on the support and the photosensitive layer.

As the support, those having conductivity (conductive support) can be used, and metallic supports formed with a metal such as aluminum, an aluminum alloy, and stainless steel can be used. In a case where aluminum or an aluminum alloy is used, an aluminum tube produced by a production method including extrusion and drawing or an aluminum tube produced by a production method including extrusion and ironing can be used. Such an aluminum tube has high precision of the size and surface smoothness without machining the surface, and has an advantage from the viewpoint of cost. However, defects like ragged projections are often produced on the surface of the aluminum tube not machined. Accordingly, provision of the conductive layer easily allows covering of the defects like ragged projections on the surface of the non-machined aluminum tube.

In the method for producing an electrophotographic photosensitive member according to the present invention, in order to cover the defects produced on the surface of the support, the conductive layer having a volume resistivity of not less than $1.0\times10^{8}$ Ω·cm and not more than $5.0\times10^{12}$ Ω·cm is provided on the support. As a layer for covering the defects produced on the surface of the support, if a layer having a volume resistivity of more than $5.0\times10^{12}$ Ω·cm is provided on the support, a flow of charges is likely to stagnate during image formation to increase the residual potential, and change dark potential and bright potential. Meanwhile, if the conductive layer has a volume resistivity less than $1.0\times10^{8}$ Ω·cm, an excessive amount of charges flows in the conductive layer during charging of the electrophotographic photosensitive member, and the leakage is likely to occur.

Figure 2:
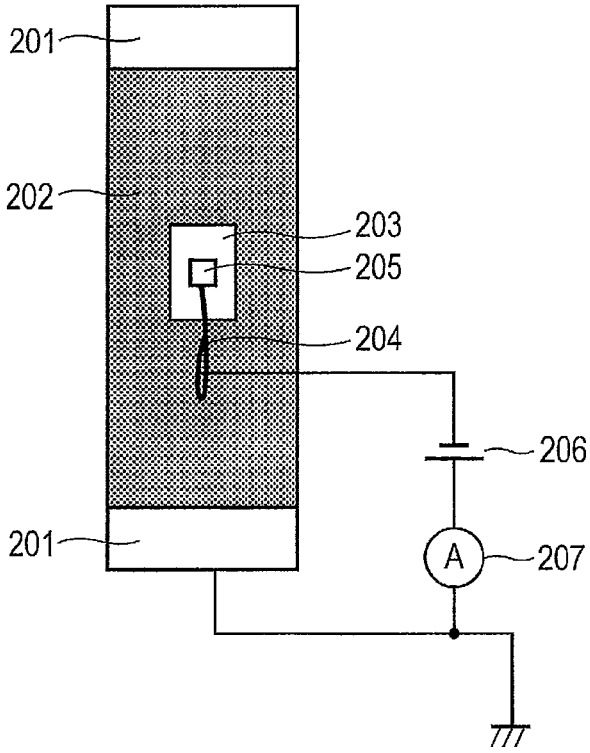
FIG. 2 is a drawing (top view) for describing a method for measuring a volume resistivity of a conductive layer.
Figure 3:
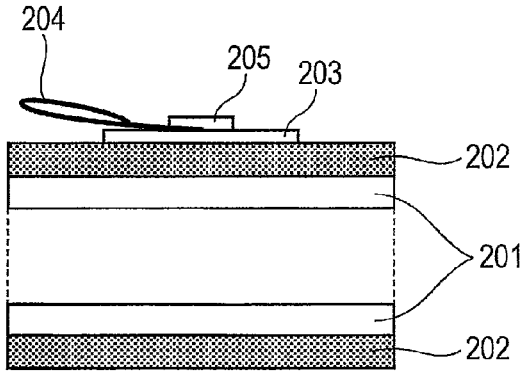
FIG. 3 is a drawing (sectional view) for describing a method for measuring a volume resistivity of a conductive layer.

Using FIG. 2 and FIG. 3, a method for measuring the volume resistivity of the conductive layer in the electrophotographic photosensitive member will be described. FIG. 2 is a top view for describing a method for measuring a volume resistivity of a conductive layer, and FIG. 3 is a sectional view for describing a method for measuring a volume resistivity of a conductive layer.

The volume resistivity of the conductive layer is measured under an environment of normal temperature and normal humidity (23° C./50% RH). A copper tape 203 (made by Sumitomo 3M Limited, No. 1181) is applied to the surface of the conductive layer 202, and the copper tape is used as an electrode on the side of the surface of the conductive layer 202. The support 201 is used as an electrode on a rear surface side of the conductive layer 202. Between the copper tape 203 and the support 201, a power supply 206 for applying voltage, and a current measurement apparatus 207 for measuring the current that flows between the copper tape 203 and the support 201 are provided. In order to apply voltage to the copper tape 203, a copper wire 204 is placed on the copper tape 203, and a copper tape 205 similar to the copper tape 203 is applied onto the copper wire 204 such that the copper wire 204 is not out of the copper tape 203, to fix the copper wire 204 to the copper tape 203. The voltage is applied to the copper tape 203 using the copper wire 204.

The value represented by the following relation (1) is the volume resistivity ρ [Ω·cm] of the conductive layer 202 wherein $I_0$ [A] is a background current value when no voltage is applied between the copper tape 203 and the support 201, I [A] is a current value when −1 V of the voltage having only a DC voltage (DC component) is applied, the film thickness of the conductive layer 202 is d [cm], and the area of the electrode (copper tape 203) on the surface side of the conductive layer 202 is S [$cm^2$]:

$$\rho=1/(I-I_0)\times S/d\ [\Omega\cdot\mathrm{cm}] \quad (1)$$

In this measurement, a slight amount of the current of not more than $1\times10^{-6}$ A in an absolute value is measured. Accordingly, the measurement is preferably performed using a current measurement apparatus 207 that can measure such a slight amount of the current. Examples of such an apparatus include a pA meter (trade name: 4140B) made by Yokogawa Hewlett-Packard Ltd.

The volume resistivity of the conductive layer indicates the same value when the volume resistivity is measured in the state where only the conductive layer is formed on the support and in the state where the respective layers (such as the photosensitive layer) on the conductive layer are removed from the electrophotographic photosensitive member and only the conductive layer is left on the support.

In the method for producing an electrophotographic photosensitive member according to the present invention, the conductive layer is formed using a coating liquid for a conductive layer prepared using a solvent, a binder material, and a metallic oxide particle.

Moreover, in the coating liquid for a conductive layer used in formation of the conductive layer (the step (i)) according to the present invention, a titanium oxide particle coated with tin oxide doped with phosphorus, a titanium oxide particle coated with tin oxide doped with tungsten, or a titanium oxide particle coated with tin oxide doped with fluorine (hereinafter, also referred to as a "P/W/F-doped-tin oxide-coated titanium oxide particle") is used as the metallic oxide particle.

A coating liquid for a conductive layer can be prepared by dispersing metallic oxide particles (P/W/F-doped-tin oxide-coated titanium oxide particle) together with a binder material in a solvent. Examples of a dispersion method include methods using a paint shaker, a sand mill, a ball mill, and a liquid collision type high-speed dispersing machine. The thus-prepared coating liquid for a conductive layer can be applied onto the support, and the obtained coating film is dried and/or cured to form a conductive layer.

The metallic oxide particle used in the present invention (P/W/F-doped-tin oxide-coated titanium oxide particle) has a water content of not less than 1.0% by mass and not more than 2.0% by mass.

If the P/W/F-doped-tin oxide-coated titanium oxide particle has a water content of less than 1.0% by mass, an excessive amount of charges flows in the conductive layer during charging of the electrophotographic photosensitive member, and the leakage is likely to occur. Use of the P/W/F-doped-tin oxide-coated titanium oxide particle having a water content of not less than 1.0% by mass as a metal oxide for the conductive layer leads to improvement in the resistance to leakage (difficulties for the leakage to occur) of the electrophotographic photosensitive member. Use of the P/W/F-doped-tin oxide-coated titanium oxide particle having a water content of not less than 1.2% by mass as the metal oxide for the conductive layer leads to further improvement in the resistance to leakage of the electrophotographic photosensitive member. The present inventors presume the reason as follows.

The powder resistivity of the P/W/F-doped-tin oxide-coated titanium oxide particle was measured under a normal temperature and normal humidity (23° C./50% RH) environment by the method described later. The value of the powder resistivity did not depend on the water content of the P/W/F-doped-tin oxide-coated titanium oxide particle. Accordingly, it is thought that under the condition for measuring the powder resistivity of the P/W/F-doped-tin oxide-coated titanium oxide particle, the amount of charges flowing through each P/W/F-doped-tin oxide-coated titanium oxide particle does not depend on the water content of the P/W/F-doped-tin oxide-coated titanium oxide particle.

The volume resistivity of the conductive layer containing the P/W/F-doped-tin oxide-coated titanium oxide particle was measured under the normal temperature and normal humidity (23° C./50% RH) environment by the method above. The value of the volume resistivity also did not depend on the water content of the P/W/F-doped-tin oxide-coated titanium oxide particle used in formation of the conductive layer (the step (i)). Accordingly, it is thought that also under the condition for measuring the volume resistivity of the conductive layer, the amount of charges flowing though each P/W/F-doped-tin oxide-coated titanium oxide particle does not depend on the water content of the P/W/F-doped-tin oxide-coated titanium oxide particle.

The present inventors contacted a charging roller with the electrophotographic photosensitive member according to the present invention, applied voltage to the charging roller using an external power supply, and measured the amount of the dark current of the electrophotographic photosensitive member using an ammeter. At a low voltage to be applied to the charging roller, the amount of the dark current of the electrophotographic photosensitive member did not depend on the water content of the P/W/F-doped-tin oxide-coated titanium oxide particle contained in the conductive layer.

Meanwhile, the following result was obtained: as the voltage to be applied to the charging roller is increased, the amount of the dark current of the electrophotographic photosensitive member having the conductive layer containing the P/W/F-doped-tin oxide-coated titanium oxide particle having a large water content is smaller than the amount of the dark current of the electrophotographic photosensitive member having the conductive layer containing the P/W/F-doped-tin oxide-coated titanium oxide particle having a small water content.

It is thought that the amount of the dark current of the electrophotographic photosensitive member having the conductive layer containing the P/W/F-doped-tin oxide-coated titanium oxide particle is the total sum of the amounts of charges flowing through the individual P/W/F-doped-tin oxide-coated titanium oxide particles.

It is thought that increase in the voltage to be applied to the charging roller corresponds to formation of a locally large electric field that may lead to occurrence of the leakage.

The result described above means that the amount of charges flowing through each P/W/F-doped-tin oxide-coated titanium oxide particle depends on the water content of the P/W/F-doped-tin oxide-coated titanium oxide particle when such a locally large electric field is formed. Namely, it is thought that when the locally large electric field is formed, the powder resistivity of the P/W/F-doped-tin oxide-coated titanium oxide particle having a large water content is higher than the powder resistivity of the P/W/F-doped-tin oxide-coated titanium oxide particle having a small water content.

For this reason, it is thought that in the electrophotographic photosensitive member having the conductive layer containing the P/W/F-doped-tin oxide-coated titanium oxide particle having a large water content (specifically, not less than 1.0% by mass), the P/W/F-doped-tin oxide-coated titanium oxide particle has a high powder resistivity; for this reason, local portions in which excessive current may flow are difficult to break down; as a result, the resistance to leakage of the electrophotographic photosensitive member improves.

Meanwhile, if the P/W/F-doped-tin oxide-coated titanium oxide particle has a water content of more than 2.0% by mass, the flow of charges in the conductive layer is likely to stagnate to significantly increase the residual potential when an image is repeatedly formed. Moreover, when an image is formed after the electrophotographic photosensitive member is preserved under a severe environment (for example, 40° C./90% RH), ghost is likely to occur in the output image. For these reasons, the water content of the P/W/F-doped-tin oxide-coated titanium oxide particle needs to be not more than 2.0% by mass.

For the reasons above, in the present invention, the water content of the P/W/F-doped-tin oxide-coated titanium oxide particle used in formation of the conductive layer (the step (i)) is not less than 1.0% by mass and not more than 2.0% by mass. The water content is preferably not less than 1.2% by mass and not more than 1.9% by mass, and more preferably not less than 1.3% by mass and not more than 1.6% by mass.

In the present invention, the powder resistivity of the P/W/F-doped-tin oxide-coated titanium oxide particle used in formation of the conductive layer (the step (i)) is preferably not less than $1.0\times10^1$ Ω·cm and not more than $1.0\times10^6$ Ω·cm, and more preferably not less than $1.0\times10^2$ Ω·cm and not more than $1.0\times10^5$ Ω·cm.

The proportion (coating percentage) of tin oxide ($SnO_2$) in the P/W/F-doped-tin oxide-coated titanium oxide particle can be 10 to 60% by mass. In order to control the coating percentage of tin oxide ($SnO_2$), when the P/W/F-doped-tin oxide-coated titanium oxide particle is produced, a tin raw material needed to produce tin oxide ($SnO_2$) needs to be blended. For example, in a case where tin chloride ($SnCl_4$) is used as the tin raw material, blending amount (preparation) is necessary in consideration of the amount of tin oxide ($SnO_2$) to be produced from tin chloride ($SnCl_4$). In this case, the coating percentage is a value calculated using the mass of tin oxide ($SnO_2$) based on the total mass of tin oxide ($SnO_2$) and titanium oxide ($TiO_2$) without considering the mass of phosphorus (P), tungsten (W), and fluorine (F) with which tin oxide ($SnO_2$) is doped. At a coating percentage of tin oxide ($SnO_2$) of less than 10% by mass, the titanium oxide ($TiO_2$) particle is likely to be insufficiently coated with tin oxide ($SnO_2$), and the conductivity of the P/W/F-doped-tin oxide-coated titanium oxide particle is difficult to increase. In contrast, at a coating percentage more than 60% by mass, coating of the titanium oxide ($TiO_2$) particle with tin oxide ($SnO_2$) is likely to become uneven, and cost is likely to increase.

For the conductivity of the P/W/F-doped-tin oxide-coated titanium oxide particle to be easily increased, the amount of phosphorus (P), tungsten (W), or fluorine (F) with which tin oxide ($SnO_2$) is doped can be 0.1 to 10% by mass based on tin oxide ($SnO_2$) (the mass of tin oxide containing no phosphorus (P), tungsten (W), or fluorine (F)). If the amount of phosphorus (P), tungsten (W), and fluorine (F) with which tin oxide ($SnO_2$) is doped is more than 10% by mass, crystallinity of tin oxide ($SnO_2$) is likely to be reduced. The method for producing titanium oxide particles coated with tin oxide ($SnO_2$) doped with phosphorus (P), and the like is disclosed in Japanese Patent Application Laid-Open No. 06-207118, and Japanese Patent Application Laid-Open No. 2004-349167.

The P/W/F-doped-tin oxide-coated titanium oxide particle can be produced by a production method including baking. The water content of the P/W/F-doped-tin oxide-coated titanium oxide particle can be controlled by the atmospheric condition when the particle is extracted after the baking. To increase the water content of the P/W/F-doped-tin oxide-coated titanium oxide particle, moisturization can also be performed after the baking. The moisturization means, for example, that the P/W/F-doped-tin oxide-coated titanium oxide particle is kept under a specific temperature and humidity for a specific period of time. By controlling the temperature, humidity, and time when the P/W/F-doped-tin oxide-coated titanium oxide particle is kept, the water content of the P/W/F-doped-tin oxide-coated titanium oxide particle can be controlled.

The water content of the metallic oxide particle such as the P/W/F-doped-tin oxide-coated titanium oxide particle is measured by the following measurement method.

In the present invention, an electronic moisture meter made by SHIMADZU Corporation (trade name: EB-340 MOC type) was used as the measurement apparatus. 3.30 g of a metallic oxide particle sample was kept at the setting temperature (temperature set in the electronic moisture meter) of 320° C. The loss weight value when the sample reached a bone dry state was measured. The loss weight value was divided by 3.30 g, and multiplied by 100. The obtained value was defined as the water content [% by mass] of the metallic oxide particle. The bone dry state means that the amount of the mass to be changed is ±10 mg or less. For example, when 3.30 g of the metallic oxide particle is kept at the setting temperature of 320° C., and reaches the bone dry state, and the mass of the metallic oxide particle is 3.25 g, the loss weight value is 3.30 g−3.25 g=0.05 g. Then, the water content is calculated as (0.05 g/3.30 g)×100=1.5% by mass.

The powder resistivity of the metallic oxide particle such as the P/W/F-doped-tin oxide-coated titanium oxide particle is measured by the following measurement method.

The powder resistivity of the metallic oxide particle is measured under a normal temperature and normal humidity (23° C./50% RH) environment. In the present invention, as the measurement apparatus, a resistivity meter made by Mitsubishi Chemical Corporation (trade name: Loresta GP) was used. The metallic oxide particle to be measured is a pellet-like measurement sample prepared by solidifying the metallic oxide particle at a pressure of 500 kg/cm$^2$. The voltage to be applied is 100 V.

In the present invention, as the metallic oxide particle used in the conductive layer, the P/W/F-doped-tin oxide-coated titanium oxide particle having a core material particle (titanium oxide ($TiO_2$) particle) is used for improvement in the dispersibility of the metallic oxide particle in the coating liquid for a conductive layer. If the particle including only tin oxide ($SnO_2$) doped with phosphorus (P), tungsten (W), or fluorine (F) is used, the metallic oxide particle in the coating liquid for a conductive layer is likely to have a large particle diameter, and projected granular defects occur on the surface of the conductive layer, reducing the resistance to leakage of the electrophotographic photosensitive member or the stability of the coating liquid for a conductive layer.

As the core material particle, the titanium oxide ($TiO_2$) particle is used because the resistance to leakage of the electrophotographic photosensitive member is easily improved. Further, if the titanium oxide ($TiO_2$) particle is used as the core material particle, transparency as the metallic oxide particle reduces, leading to an advantage such that the defects produced on the surface of the support are easily covered. Contrary to this, for example, if a barium sulfate particle is used as the core material particle, it is easy for a large amount of charges to flow in the conductive layer, and the resistance to leakage of the electrophotographic photosensitive member is difficult to improve. Moreover, if a barium sulfate particle is used as the core material particle, transparency as the metallic oxide particle increases. For this reason, an additional material for covering the defects produced on the surface of the support may be necessary.

As the metallic oxide particle, instead of a non-coated titanium oxide ($TiO_2$) particle, the titanium oxide ($TiO_2$) particle coated with tin oxide ($SnO_2$) doped with phosphorus (P), tungsten (W), or fluorine (F) is used because the non-coated titanium oxide ($TiO_2$) particle is likely to stagnate the flow of charges during formation of an image, increasing the residual potential, and changing dark potential and bright potential.

Examples of a binder material used for preparation of the coating liquid for a conductive layer include resins such as phenol resins, polyurethanes, polyamides, polyimides, polyamidimides, polyvinyl acetals, epoxy resins, acrylic resins, melamine resins, and polyesters. One of these or two or more thereof can be used. Among these resins, curable resins are preferable and thermosetting resins are more preferable from the viewpoint of suppressing migration (transfer) to other layer, adhesive properties to the support, the dispersibility and dispersion stability of the P/W/F-doped-tin oxide-coated titanium oxide particle, and resistance against a solvent after formation of the layer. Among the thermosetting resins, thermosetting phenol resins and thermosetting polyurethanes are preferable. In a case where a curable resin is used for the binder material for the conductive layer, the binder material contained in the coating liquid for a conductive layer is a monomer and/or oligomer of the curable resin.

Examples of a solvent used for the coating liquid for a conductive layer include alcohols such as methanol, ethanol, and isopropanol; ketones such as acetone, methyl ethyl ketone, and cyclohexanone; ethers such as tetrahydrofuran, dioxane, ethylene glycol monomethyl ether, and propylene glycol monomethyl ether; esters such as methyl acetate and ethyl acetate; and aromatic hydrocarbons such as toluene and xylene.

In the present invention, the mass ratio (P/B) of the metallic oxide particle (P/W/F-doped-tin oxide-coated titanium oxide particle) (P) to the binder material (B) in the coating liquid for a conductive layer is not less than 1.5/1.0 and not more than 3.5/1.0. At a mass ratio (P/B) of not less than 1.5/1.0, a flow of charges hardly stagnates during formation of an image, residual potential hardly increases, and dark potential and bright potential hardly change. Additionally, the volume resistivity of the conductive layer is easily adjusted to be not more than $5.0\times10^{12}$ Ω·cm. At a mass ratio (P/B) of not more than 3.5/1.0, the volume resistivity of the conductive layer is easily adjusted to be not less than $1.0\times10^{8}$ Ω·cm. Moreover, the metallic oxide particle (P/W/F-doped-tin oxide-coated titanium oxide particle) is easily bound to prevent cracks in the conductive layer, and improve the resistance to leakage.

From the viewpoint of covering the defects of the surface of the support, the film thickness of the conductive layer is preferably not less than 10 μm and not more than 40 μm, and more preferably not less than 15 μm and not more than 35 μm.

In the present invention, FISCHERSCOPE MMS made by Helmut Fischer GmbH was used as an apparatus for measuring the film thickness of each layer in the electrophotographic photosensitive member including a conductive layer.

The average particle diameter of the P/W/F-doped-tin oxide-coated titanium oxide particle in the coating liquid for a conductive layer is preferably not less than 0.10 μm and not more than 0.45 μm, and more preferably not less than 0.15 μm and not more than 0.40 μm. At an average particle diameter of not less than 0.10 μm, the P/W/F-doped-tin oxide-coated titanium oxide particle is difficult to aggregate again after preparation of the coating liquid for a conductive layer to prevent reduction in the stability of the coating liquid for a conductive layer. As a result, the surface of the conductive layer to be formed hardly cracks. At an average particle diameter of not more than 0.45 μm, an uneven surface of the conductive layer is prevented. Thereby, local injection of charges into the photosensitive layer is prevented, and the black dots produced in a white solid portion of an output image are also prevented.

The average particle diameter of the metallic oxide particle such as the P/W/F-doped-tin oxide-coated titanium oxide particle in the coating liquid for a conductive layer can be measured by liquid phase sedimentation as follows.

First, the coating liquid for a conductive layer is diluted with a solvent used for preparation of the coating liquid such that the transmittance is between 0.8 and 1.0. Next, using an ultracentrifugation automatic particle size distribution analyzer, a histogram for the average particle diameter (volume based D50) and particle size distribution of the metallic oxide particle is created. In the present invention, an ultracentrifugation automatic particle size distribution analyzer made by HORIBA, Ltd. (trade name: CAPA700) was used as the ultracentrifugation automatic particle size distribution analyzer, and the measurement was performed on the condition of rotational speed of 3000 rpm.

In order to suppress interference fringes produced on the output image by interference of the light reflected on the surface of the conductive layer, the coating liquid for a conductive layer may contain a surface roughening material for roughening the surface of the conductive layer. As the surface roughening material, resin particles having the average particle diameter of not less than 1 μm and not more than 5 μm are preferable. Examples of the resin particles include particles of curable resins such as curable rubbers, polyurethanes, epoxy resins, alkyd resins, phenol resins, polyesters, silicone resins, and acrylic-melamine resins. Among these, particles of silicone resins difficult to aggregate are preferable. The specific gravity of the resin particle (0.5 to 2) is smaller than that of the P/W/F-doped-tin oxide-coated titanium oxide particle (4 to 7). For this reason, the surface of the conductive layer is efficiently roughened at the time of forming the conductive layer. However, as the content of the surface roughening material in the conductive layer is larger, the volume resistivity of the conductive layer is likely to be increased. Accordingly, in order to adjust the volume resistivity of the conductive layer in the range of not more than $5.0\times10^{12}$ Ω·cm, the content of the surface roughening material in the coating liquid for a conductive layer is preferably 1 to 80% by mass based on the binder material in the coating liquid for a conductive layer.

The coating liquid for a conductive layer may also contain a leveling agent for increasing surface properties of the conductive layer. The coating liquid for a conductive layer may also contain pigment particles for improving covering properties to the conductive layer.

In the method for producing an electrophotographic photosensitive member according to the present invention, in order to prevent charge injection from the conductive layer to the photosensitive layer, an undercoat layer (barrier layer) having electrical barrier properties may be provided between the conductive layer and the photosensitive layer.

The undercoat layer can be formed by applying a coating solution for an undercoat layer containing a resin (binder resin) onto the conductive layer, and drying the obtained coating film.

Examples of the resin (binder resin) used for the undercoat layer include water soluble resins such as polyvinyl alcohol, polyvinyl methyl ether, polyacrylic acids, methyl cellulose, ethyl cellulose, polyglutamic acid, casein, and starch, polyamides, polyimides, polyamidimides, polyamic acids, melamine resins, epoxy resins, polyurethanes, and polyglutamic acid esters. Among these, in order to produce electrical barrier properties of the undercoat layer effectively, thermoplastic resins are preferable. Among the thermoplastic resins, thermoplastic polyamides are preferable. As polyamides, copolymerized nylons are preferable.

The film thickness of the undercoat layer is preferably not less than 0.1 μm and not more than 2 μm.

In order to prevent a flow of charges from stagnating in the undercoat layer, the undercoat layer may contain an electron transport substance (electron-receptive substance such as an acceptor).

Examples of the electron transport substance include electron-withdrawing substances such as 2,4,7-trinitrofluorenone, 2,4,5,7-tetranitrofluorenone, chloranil, and tetracyanoquinodimethane, and polymerized products of these electron-withdrawing substances.

On the conductive layer (undercoat layer), the photosensitive layer is provided.

Examples of the charge-generating substance used for the photosensitive layer include azo pigments such as monoazos, disazos, and trisazos; phthalocyanine pigments such as metal phthalocyanine and non-metallic phthalocyanine; indigo pigments such as indigo and thioindigo; perylene pigments such as perylene acid anhydrides and perylene acid imides; polycyclic quinone pigments such as anthraquinone and pyrenequinone; squarylium dyes; pyrylium salts and thiapyrylium salts; triphenylmethane dyes; quinacridone pigments; azulenium salt pigments; cyanine dyes; xanthene dyes; quinoneimine dyes; and styryl dyes. Among these, metal phthalocyanines such as oxytitanium phthalocyanine, hydroxy gallium phthalocyanine, and chlorogallium phthalocyanine are preferable.

In a case where the photosensitive layer is a laminated photosensitive layer, a coating solution for a charge-generating layer prepared by dispersing a charge-generating substance and a binder resin in a solvent can be applied and the obtained coating film is dried to form a charge-generating layer. Examples of the dispersion method include methods using a homogenizer, an ultrasonic wave, a ball mill, a sand mill, an attritor, or a roll mill.

Examples of the binder resin used for the charge-generating layer include polycarbonates, polyesters, polyarylates, butyral resins, polystyrenes, polyvinyl acetals, diallyl phthalate resins, acrylic resins, methacrylic resins, vinyl acetate resins, phenol resins, silicone resins, polysulfones, styrene-butadiene copolymers, alkyd resins, epoxy resins, urea resins, and vinyl chloride-vinyl acetate copolymers. One of these can be used alone, or two or more thereof can be used as a mixture or a copolymer.

The proportion of the charge-generating substance to the binder resin (charge-generating substance:binder resin) is preferably in the range of 10:1 to 1:10 (mass ratio), and more preferably in the range of 5:1 to 1:1 (mass ratio).

Examples of the solvent used for the coating solution for a charge-generating layer include alcohols, sulfoxides, ketones, ethers, esters, aliphatic halogenated hydrocarbons, and aromatic compounds.

The film thickness of the charge-generating layer is preferably not more than 5 μm, and more preferably not less than 0.1 μm and not more than 2 μm.

To the charge-generating layer, a variety of additives such as a sensitizer, an antioxidant, an ultraviolet absorbing agent, and a plasticizer can be added when necessary. In order to prevent a flow of charges from stagnating in the charge-generating layer, the charge-generating layer may contain an electron transport substance (an electron-receptive substance such as an acceptor).

Examples of the electron transport substance include electron-withdrawing substances such as 2,4,7-trinitrofluorenone, 2,4,5,7-tetranitrofluorenone, chloranil, and tetracyanoquinodimethane, and polymerized products of these electron-withdrawing substances.

Examples of the charge transport substance used for the photosensitive layer include triarylamine compounds, hydrazone compounds, styryl compounds, stilbene compounds, pyrazoline compounds, oxazole compounds, thiazole compounds, and triallylmethane compounds.

In a case where the photosensitive layer is a laminated photosensitive layer, a coating solution for a charge transport layer prepared by dissolving the charge transport substance and a binder resin in a solvent can be applied and the obtained coating film is dried to form a charge transport layer.

Examples of the binder resin used for the charge transport layer include acrylic resins, styrene resins, polyesters, polycarbonates, polyarylates, polysulfones, polyphenylene oxides, epoxy resins, polyurethanes, alkyd resins, and unsaturated resins. One of these can be used alone, or two or more thereof can be used as a mixture or a copolymer.

The proportion of the charge transport substance to the binder resin (charge transport substance:binder resin) is preferably in the range of 2:1 to 1:2 (mass ratio).

Examples of the solvent used for the coating solution for a charge transport layer include ketones such as acetone and methyl ethyl ketone; esters such as methyl acetate and ethyl acetate; ethers such as dimethoxymethane and dimethoxyethane; aromatic hydrocarbons such as toluene and xylene; and hydrocarbons substituted by a halogen atom such as chlorobenzene, chloroform, and carbon tetrachloride.

From the viewpoint of charging uniformity and reproductivity of an image, the film thickness of the charge transport layer is preferably not less than 3 μm and not more than 40 μm, and more preferably not less than 4 μm and not more than 30 μm.

To the charge transport layer, an antioxidant, an ultraviolet absorbing agent, and a plasticizer can be added when necessary.

In a case where the photosensitive layer is a single photosensitive layer, a coating solution for a single photosensitive layer containing a charge-generating substance, a charge transport substance, a binder resin, and a solvent can be applied and the obtained coating film is dried to form a single photosensitive layer. As the charge-generating substance, the charge transport substance, the binder resin, and the solvent, a variety of the materials described above can be used, for example.

On the photosensitive layer, a protective layer may be provided to protect the photosensitive layer.

A coating solution for a protective layer containing a resin (binder resin) can be applied and the obtained coating film is dried and/or cured to form a protective layer.

The film thickness of the protective layer is preferably not less than 0.5 μm and not more than 10 μm, and more preferably not less than 1 μm and not more than 8 μm.

In application of the coating solutions for the respective layers above, application methods such as a dip coating method (an immersion coating method), a spray coating method, a spin coating method, a roll coating method, a Meyer bar coating method, and a blade coating method can be used.

FIG. 1 illustrates an example of a schematic configuration of an electrophotographic apparatus including a process cartridge having an electrophotographic photosensitive member.

In FIG. 1, a drum type (cylindrical type) electrophotographic photosensitive member 1 is rotated and driven around a shaft 2 in the arrow direction at a predetermined circumferential speed.

The surface (circumferential surface) of the electrophotographic photosensitive member 1 rotated and driven is uniformly charged at a predetermined positive or negative potential by a charging unit (a primary charging unit, a charging roller, or the like) 3. Next, the circumferential surface of the electrophotographic photosensitive member 1 receives exposure light (image exposure light) 4 output from an exposing unit such as slit exposure or laser beam scanning exposure (not illustrated). Thus, an electrostatic latent image corresponding to a target image is sequentially formed on the circumferential surface of the electrophotographic photosensitive member 1. The voltage applied to the charging unit 3 may be only DC voltage, or DC voltage on which AC voltage is superimposed.

The electrostatic latent image formed on the circumferential surface of the electrophotographic photosensitive member 1 is developed by a toner of a developing unit 5 to form a toner image. Next, the toner image formed on the circumferential surface of the electrophotographic photosensitive member 1 is transferred onto a transfer material (such as paper) P by a transfer bias from a transferring unit (such as a transfer roller) 6. The transfer material P is fed from a transfer material feeding unit (not illustrated) between the electrophotographic photosensitive member 1 and the transferring unit 6 (contact region) in synchronization with rotation of the electrophotographic photosensitive member 1.

The transfer material P having the toner image transferred is separated from the circumferential surface of the electrophotographic photosensitive member 1, and introduced to a fixing unit 8 to fix the image. Thereby, an image forming product (print, copy) is printed out of the apparatus.

From the circumferential surface of the electrophotographic photosensitive member 1 after transfer of the toner image, the remaining toner of transfer is removed by a cleaning unit (such as a cleaning blade) 7. Further, the circumferential surface of the electrophotographic photosensitive member 1 is discharged by pre-exposure light 11 from a pre-exposing unit (not illustrated), and is repeatedly used for image formation. In a case where the charging unit is a contact charging unit such as a charging roller, the pre-exposure is not always necessary.

The electrophotographic photosensitive member 1 and at least one component selected from the charging unit 3, the developing unit 5, the transferring unit 6, and the cleaning unit 7 may be accommodated in a container and integrally supported as a process cartridge, and the process cartridge may be detachably attached to the main body of the electrophotographic apparatus. In FIG. 1, the electrophotographic photosensitive member 1, the charging unit 3, the developing unit 5, and the cleaning unit 7 are integrally supported to form a process cartridge 9, which is detachably attached to the main body of the electrophotographic apparatus using a guide unit 10 such as a rail in the main body of the electrophotographic apparatus. The electrophotographic apparatus may include the electrophotographic photosensitive member 1, the charging unit 3, the exposing unit, the developing unit 5, and the transferring unit 6.

EXAMPLE

Hereinafter, using specific Examples, the present invention will be described more in detail. However, the present invention will not be limited to these. In Examples, "parts" mean "parts by mass."

<Production Example of Metallic Oxide Particle>

100 g of a powder including a titanium oxide particle (spherical titanium oxide particle produced by a sulfuric acid method and having a purity of 98.0%, an average primary particle diameter of 210 nm, and a BET value of 7.8 $m^2/g$) and 1 g of hexametaphosphoric acid were added to 500 ml of water, and these materials were placed in a bead mill, and dispersed. During dispersion, the isoelectric point of the titanium oxide particle used was avoided, and a pH (pH=9 to 11) was kept. After the dispersion, the slurry was heated to 95° C. A tin chloride aqueous solution was added to the dispersion liquid at an amount of 80 g in terms of tin oxide. At this time, phosphoric acid was added to the tin chloride aqueous solution such that phosphorus was 1% by mass based on the mass of tin oxide. By a hydrolysis reaction, crystals of a tin hydroxide were deposited on the surface of the titanium oxide particle. The powder of the thus-treated (wet treatment) titanium oxide particle was extracted, washed, and dried. Substantially, the total amount of tin chloride added in the wet treatment above was hydrolyzed, and deposited as a tin(IV) hydroxide compound on the surface of the titanium oxide particle. 20 g of the dried powder of the titanium oxide particle was placed in a quartz tube furnace, and the temperature was raised at a temperature raising rate of 10° C./min. While the temperature was controlled in the range of 700±50° C., the powder was baked for 2 hours in a nitrogen atmosphere. After the baking, as moisturization of the powder, the powder was kept for 60 minutes under an 80° C./90% RH environment. Subsequently, the moisturized powder was crushed to obtain a titanium oxide particle coated with tin oxide doped with phosphorus (average primary particle diameter: 230 nm, powder resistivity: $5.0\times10^3$ Ω·cm, water content: 1.5% by mass, BET value: 46.0 $m^2/g$).

<Preparation Example of Coating Liquid for a Conductive Layer>

(Preparation Example of Coating Liquid for a Conductive Layer 1)

207 parts of the titanium oxide ($TiO_2$) particle coated with tin oxide ($SnO_2$) doped with phosphorus (P) as the metallic oxide particle and obtained in Production Example of the metallic oxide particle above, 144 parts of a phenol resin (monomer/oligomer of a phenol resin) as the binder material (trade name: Plyophen J-325, made by DIC Corporation, resin solid content: 60% by mass), and 98 parts of 1-methoxy-2-propanol as a solvent were placed in a sand mill using 450 parts of glass beads having a diameter of 0.8 mm, and dispersed under conditions: rotational speed, 2000 rpm; dispersion time, 4.5 hours; and the setting temperature of cooling water, 18° C. to obtain a dispersion liquid.

The glass beads were removed from the dispersion liquid with a mesh (opening: 150 μm).

A silicone resin particle as the surface roughening material (trade name: Tospearl 120, made by Momentive Performance Materials Inc., average particle diameter of 2 μm) was added to the dispersion liquid after the glass beads were removed, such that the amount of the silicone resin particle was 15% by mass based on the total mass of the metallic oxide particle and the binder material in the dispersion liquid. Additionally, a silicone oil as the leveling agent (trade name: SH28PA, made by Dow Corning Toray Co., Ltd.) was added to the dispersion liquid such that the amount of the silicone oil was 0.01% by mass based on the total mass of the metallic oxide particle and the binder material in the dispersion liquid.

Next, a mixed solvent of methanol and 1-methoxy-2-propanol (mass ratio of 1:1) was added to the dispersion liquid such that the total mass of the metallic oxide particle, the binder material, and the surface roughening material in the dispersion liquid (namely, mass of the solid content) was 67% by mass based on the mass of the dispersion liquid. The solution was stirred to prepare a coating liquid for a conductive layer 1.

The proportion of the total mass of the metallic oxide particle and the binder material in the dispersion liquid before adding the surface roughening material to the mass of the dispersion liquid, and the proportion of the total mass of the metallic oxide particle, the binder material, and the surface roughening material in the dispersion liquid after adding the surface roughening material to the mass of the dispersion liquid were measured using an electronic balance as follows.

1. An aluminum cake cup is weighed (A [mg]).
2. The electronic balance is set at 0 mg in the state where the aluminum cake cup is placed on the electronic balance.
3. Approximately 1 g of the dispersion liquid is dropped into the aluminum cake cup with a pipette, and the dispersion liquid is weighed (B [mg]).
4. The aluminum cake cup containing the dispersion liquid is preserved for 30 minutes inside of a dryer whose temperature is set at 150° C.
5. The aluminum cake cup is taken out from the dryer, and weighed (C [mg]).

6. The proportion of the solid content to the mass of the dispersion liquid is calculated by the following expression.

$$\text{Proportion of solid content to mass of dispersion liquid}=\{(C-A)/B\}\times 100\ [\%\ \text{by mass}]$$

(Preparation Examples of Coating Liquids for a Conductive Layer 2 to 60 and C1 to C75)

Coating liquids for a conductive layer 2 to 60 and C1 to C75 were prepared by the same operation as that in Preparation Example of the coating liquid for a conductive layer 1 except that the kind, water content, powder resistivity, and amount (parts) of the metallic oxide particle used for preparation of the coating liquid for a conductive layer, the amount (parts) of the phenol resin (monomer/oligomer of the phenol resin) as the binder material, and the dispersion time were changed as shown in Tables 1 to 8.

In Tables 1 to 8, tin oxide is expressed "$SnO_2$," and titanium oxide is expressed as "$TiO_2$." All of the phosphorus/tungsten-doped-tin oxide coated titanium oxide particles used in Examples in Japanese Patent Application Laid-Open No. 2012-18371 had a water content of not more than 0.9% by mass. All of the metallic oxide particles used in Examples in Japanese Patent Application Laid-Open No. 2012-18370 had a water content of not more than 0.9% by mass.

TABLE 1

| | Metallic oxide particle (P) | | | | Binder material (B) (phenol resin) Amount | | P/B in |
|---|---|---|---|---|---|---|---|
| Coating liquid for conductive layer | Kind | Water content [% by mass] | Powder resistivity [Ω · cm] | Amount [parts] | [parts] (resin solid content is 60% by mass of amount below) | Dispersion time [h] | coating liquid for conductive layer |
| 1 | Titanium oxide | 1.5 | $5.0 \times 10^3$ | 207 | 144 | 4.5 | 2.4/1 |
| 2 | particle coated | 1.1 | $5.0 \times 10^3$ | 207 | 144 | 4.5 | 2.4/1 |
| 3 | with tin oxide | 1.2 | $5.0 \times 10^3$ | 207 | 144 | 4.5 | 2.4/1 |
| 4 | doped with | 1.4 | $5.0 \times 10^3$ | 207 | 144 | 4.5 | 2.4/1 |
| 5 | phosphorus | 1.0 | $5.0 \times 10^3$ | 207 | 144 | 4.5 | 2.4/1 |
| 6 | (average | 1.8 | $5.0 \times 10^3$ | 207 | 144 | 4.5 | 2.4/1 |
| 7 | primary | 1.9 | $5.0 \times 10^3$ | 207 | 144 | 4.5 | 2.4/1 |
| 8 | particle | 2.0 | $5.0 \times 10^3$ | 207 | 144 | 4.5 | 2.4/1 |
| 9 | diameter of | 1.0 | $5.0 \times 10^3$ | 176 | 195 | 4.5 | 1.5/1 |
| 10 | 230 nm) | 1.4 | $5.0 \times 10^3$ | 176 | 195 | 4.5 | 1.5/1 |
| 11 | | 2.0 | $5.0 \times 10^3$ | 176 | 195 | 4.5 | 1.5/1 |
| 12 | | 1.0 | $5.0 \times 10^3$ | 228 | 109 | 4.5 | 3.5/1 |
| 13 | | 1.4 | $5.0 \times 10^3$ | 228 | 109 | 4.5 | 3.5/1 |
| 14 | | 2.0 | $5.0 \times 10^3$ | 228 | 109 | 4.5 | 3.5/1 |
| 15 | | 1.4 | $5.0 \times 10^3$ | 176 | 195 | 6.0 | 1.5/1 |
| 16 | | 1.4 | $5.0 \times 10^3$ | 228 | 109 | 1.5 | 3.5/1 |
| 17 | | 1.4 | $1.0 \times 10^2$ | 207 | 144 | 4.5 | 2.4/1 |
| 18 | | 1.4 | $5.0 \times 10^2$ | 207 | 144 | 4.5 | 2.4/1 |
| 19 | | 1.4 | $5.0 \times 10^4$ | 207 | 144 | 4.5 | 2.4/1 |
| 20 | | 1.4 | $5.0 \times 10^5$ | 207 | 144 | 4.5 | 2.4/1 |

TABLE 2

| | Metallic oxide particle (P) | | | | Binder material (B) (phenol resin) Amount | | P/B in |
|---|---|---|---|---|---|---|---|
| Coating liquid for conductive layer | Kind | Water content [% by mass] | Powder resistivity [Ω · cm] | Amount [parts] | [parts] (resin solid content is 60% by mass of amount below) | Dispersion time [h] | coating liquid for conductive layer |
| 21 | Titanium oxide | 1.5 | $5.0 \times 10^3$ | 207 | 144 | 4.5 | 2.4/1 |
| 22 | particle coated | 1.1 | $5.0 \times 10^3$ | 207 | 144 | 4.5 | 2.4/1 |
| 23 | with tin oxide | 1.2 | $5.0 \times 10^3$ | 207 | 144 | 4.5 | 2.4/1 |
| 24 | doped with | 1.4 | $5.0 \times 10^3$ | 207 | 144 | 4.5 | 2.4/1 |
| 25 | tungsten | 1.0 | $5.0 \times 10^3$ | 207 | 144 | 4.5 | 2.4/1 |
| 26 | (average | 1.8 | $5.0 \times 10^3$ | 207 | 144 | 4.5 | 2.4/1 |
| 27 | primary | 1.9 | $5.0 \times 10^3$ | 207 | 144 | 4.5 | 2.4/1 |
| 28 | particle | 2.0 | $5.0 \times 10^3$ | 207 | 144 | 4.5 | 2.4/1 |
| 29 | diameter of | 1.0 | $5.0 \times 10^3$ | 176 | 195 | 4.5 | 1.5/1 |
| 30 | 230 nm) | 1.4 | $5.0 \times 10^3$ | 176 | 195 | 4.5 | 1.5/1 |
| 31 | | 2.0 | $5.0 \times 10^3$ | 176 | 195 | 4.5 | 1.5/1 |
| 32 | | 1.0 | $5.0 \times 10^3$ | 228 | 109 | 4.5 | 3.5/1 |
| 33 | | 1.4 | $5.0 \times 10^3$ | 228 | 109 | 4.5 | 3.5/1 |
| 34 | | 2.0 | $5.0 \times 10^3$ | 228 | 109 | 4.5 | 3.5/1 |
| 35 | | 1.4 | $5.0 \times 10^3$ | 176 | 195 | 6.0 | 1.5/1 |
| 36 | | 1.4 | $5.0 \times 10^3$ | 228 | 109 | 1.5 | 3.5/1 |
| 37 | | 1.4 | $1.0 \times 10^2$ | 207 | 144 | 4.5 | 2.4/1 |
| 38 | | 1.4 | $5.0 \times 10^2$ | 207 | 144 | 4.5 | 2.4/1 |

TABLE 2-continued

| Coating liquid for conductive layer | Metallic oxide particle (P) Kind | Water content [% by mass] | Powder resistivity [Ω · cm] | Amount [parts] | Binder material (B) (phenol resin) Amount [parts] (resin solid content is 60% by mass of amount below) | Dispersion time [h] | P/B in coating liquid for conductive layer |
|---|---|---|---|---|---|---|---|
| 39 | | 1.4 | $5.0 \times 10^4$ | 207 | 144 | 4.5 | 2.4/1 |
| 40 | | 1.4 | $5.0 \times 10^5$ | 207 | 144 | 4.5 | 2.4/1 |

TABLE 3

| Coating liquid for conductive layer | Metallic oxide particle (P) Kind | Water content [% by mass] | Powder resistivity [Ω · cm] | Amount [parts] | Binder material (B) (phenol resin) Amount [parts] (resin solid content is 60% by mass of amount below) | Dispersion time [h] | P/B in coating liquid for conductive layer |
|---|---|---|---|---|---|---|---|
| 41 | Titanium oxide | 1.5 | $5.0 \times 10^3$ | 207 | 144 | 4.5 | 2.4/1 |
| 42 | particle coated | 1.1 | $5.0 \times 10^3$ | 207 | 144 | 4.5 | 2.4/1 |
| 43 | with tin oxide | 1.2 | $5.0 \times 10^3$ | 207 | 144 | 4.5 | 2.4/1 |
| 44 | doped with | 1.4 | $5.0 \times 10^3$ | 207 | 144 | 4.5 | 2.4/1 |
| 45 | fluorine | 1.0 | $5.0 \times 10^3$ | 207 | 144 | 4.5 | 2.4/1 |
| 46 | (average | 1.8 | $5.0 \times 10^3$ | 207 | 144 | 4.5 | 2.4/1 |
| 47 | primary | 1.9 | $5.0 \times 10^3$ | 207 | 144 | 4.5 | 2.4/1 |
| 48 | particle | 2.0 | $5.0 \times 10^3$ | 207 | 144 | 4.5 | 2.4/1 |
| 49 | diameter of | 1.0 | $5.0 \times 10^3$ | 176 | 195 | 4.5 | 1.5/1 |
| 50 | 230 nm) | 1.4 | $5.0 \times 10^3$ | 176 | 195 | 4.5 | 1.5/1 |
| 51 | | 2.0 | $5.0 \times 10^3$ | 176 | 195 | 4.5 | 1.5/1 |
| 52 | | 1.0 | $5.0 \times 10^3$ | 228 | 109 | 4.5 | 3.5/1 |
| 53 | | 1.4 | $5.0 \times 10^3$ | 228 | 109 | 4.5 | 3.5/1 |
| 54 | | 2.0 | $5.0 \times 10^3$ | 228 | 109 | 4.5 | 3.5/1 |
| 55 | | 1.4 | $5.0 \times 10^3$ | 176 | 195 | 6.0 | 1.5/1 |
| 56 | | 1.4 | $5.0 \times 10^3$ | 228 | 109 | 1.5 | 3.5/1 |
| 57 | | 1.4 | $1.0 \times 10^2$ | 207 | 144 | 4.5 | 2.4/1 |
| 58 | | 1.4 | $5.0 \times 10^2$ | 207 | 144 | 4.5 | 2.4/1 |
| 59 | | 1.4 | $5.0 \times 10^4$ | 207 | 144 | 4.5 | 2.4/1 |
| 60 | | 1.4 | $5.0 \times 10^5$ | 207 | 144 | 4.5 | 2.4/1 |

TABLE 4

| Coating liquid for conductive layer | Metallic oxide particle (P) Kind | Water content [% by mass] | Powder resistivity [Ω · cm] | Amount [parts] | Binder material (B) (phenol resin) Amount [parts] (resin solid content is 60% by mass of amount below) | Dispersion time [h] | P/B in coating liquid for conductive layer |
|---|---|---|---|---|---|---|---|
| C1 | Titanium oxide | 0.8 | $5.0 \times 10^3$ | 207 | 144 | 4.5 | 2.4/1 |
| C2 | particle coated | 0.9 | $5.0 \times 10^3$ | 207 | 144 | 4.5 | 2.4/1 |
| C3 | with tin oxide | 2.1 | $5.0 \times 10^3$ | 207 | 144 | 4.5 | 2.4/1 |
| C4 | doped with | 2.2 | $5.0 \times 10^3$ | 207 | 144 | 4.5 | 2.4/1 |
| C5 | phosphorus | 0.9 | $5.0 \times 10^3$ | 176 | 195 | 4.5 | 1.5/1 |
| C6 | (average | 2.1 | $5.0 \times 10^3$ | 176 | 195 | 4.5 | 1.5/1 |
| C7 | primary | 0.9 | $5.0 \times 10^3$ | 228 | 109 | 4.5 | 3.5/1 |
| C8 | particle | 2.1 | $5.0 \times 10^3$ | 228 | 109 | 4.5 | 3.5/1 |
| C9 | diameter of | 1.0 | $5.0 \times 10^3$ | 171 | 203 | 4.5 | 1.4/1 |
| C10 | 230 nm) | 2.0 | $5.0 \times 10^3$ | 171 | 203 | 4.5 | 1.4/1 |
| C11 | | 1.0 | $5.0 \times 10^3$ | 285 | 132 | 4.5 | 3.6/1 |
| C12 | | 2.0 | $5.0 \times 10^3$ | 285 | 132 | 4.5 | 3.6/1 |
| C13 | | 1.4 | $5.0 \times 10^3$ | 176 | 195 | 8.0 | 1.5/1 |
| C14 | | 1.4 | $5.0 \times 10^3$ | 228 | 109 | 1.0 | 3.5/1 |
| C15 | Titanium oxide | 0.8 | $5.0 \times 10^3$ | 207 | 144 | 4.5 | 2.4/1 |
| C16 | particle coated | 0.9 | $5.0 \times 10^3$ | 207 | 144 | 4.5 | 2.4/1 |
| C17 | with tin oxide | 2.1 | $5.0 \times 10^3$ | 207 | 144 | 4.5 | 2.4/1 |

TABLE 4-continued

| Coating liquid for conductive layer | Metallic oxide particle (P) Kind | Water content [% by mass] | Powder resistivity [Ω · cm] | Amount [parts] | Binder material (B) (phenol resin) Amount [parts] (resin solid content is 60% by mass of amount below) | Dispersion time [h] | P/B in coating liquid for conductive layer |
|---|---|---|---|---|---|---|---|
| C18 | doped with | 2.2 | $5.0 \times 10^3$ | 207 | 144 | 4.5 | 2.4/1 |
| C19 | tungsten | 0.9 | $5.0 \times 10^3$ | 176 | 195 | 4.5 | 1.5/1 |
| C20 | (average | 2.1 | $5.0 \times 10^3$ | 176 | 195 | 4.5 | 1.5/1 |
| C21 | primary | 0.9 | $5.0 \times 10^3$ | 228 | 109 | 4.5 | 3.5/1 |
| C22 | particle | 2.1 | $5.0 \times 10^3$ | 228 | 109 | 4.5 | 3.5/1 |
| C23 | diameter of | 1.0 | $5.0 \times 10^3$ | 171 | 203 | 4.5 | 1.4/1 |
| C24 | 230 nm) | 2.0 | $5.0 \times 10^3$ | 171 | 203 | 4.5 | 1.4/1 |
| C25 | | 1.0 | $5.0 \times 10^3$ | 285 | 132 | 4.5 | 3.6/1 |
| C26 | | 2.0 | $5.0 \times 10^3$ | 285 | 132 | 4.5 | 3.6/1 |
| C27 | | 1.4 | $5.0 \times 10^3$ | 176 | 195 | 8.0 | 1.5/1 |
| C28 | | 1.4 | $5.0 \times 10^3$ | 228 | 109 | 1.0 | 3.5/1 |

TABLE 5

| Coating liquid for conductive layer | Metallic oxide particle (P) Kind | Water content [% by mass] | Powder resistivity [Ω · cm] | Amount [parts] | Binder material (B) (phenol resin) Amount [parts] (resin solid content is 60% by mass of amount below) | Dispersion time [h] | P/B in coating liquid for conductive layer |
|---|---|---|---|---|---|---|---|
| C29 | Titanium | 0.8 | $5.0 \times 10^3$ | 207 | 144 | 4.5 | 2.4/1 |
| C30 | oxide particle | 0.9 | $5.0 \times 10^3$ | 207 | 144 | 4.5 | 2.4/1 |
| C31 | coated with | 2.1 | $5.0 \times 10^3$ | 207 | 144 | 4.5 | 2.4/1 |
| C32 | tin oxide | 2.2 | $5.0 \times 10^3$ | 207 | 144 | 4.5 | 2.4/1 |
| C33 | doped with | 0.9 | $5.0 \times 10^3$ | 176 | 195 | 4.5 | 1.5/1 |
| C34 | fluorine | 2.1 | $5.0 \times 10^3$ | 176 | 195 | 4.5 | 1.5/1 |
| C35 | (average | 0.9 | $5.0 \times 10^3$ | 228 | 109 | 4.5 | 3.5/1 |
| C36 | primary | 2.1 | $5.0 \times 10^3$ | 228 | 109 | 4.5 | 3.5/1 |
| C37 | particle | 1.0 | $5.0 \times 10^3$ | 171 | 203 | 4.5 | 1.4/1 |
| C38 | diameter of | 2.0 | $5.0 \times 10^3$ | 171 | 203 | 4.5 | 1.4/1 |
| C39 | 230 nm) | 1.0 | $5.0 \times 10^3$ | 285 | 132 | 4.5 | 3.6/1 |
| C40 | | 2.0 | $5.0 \times 10^3$ | 285 | 132 | 4.5 | 3.6/1 |
| C41 | | 1.4 | $5.0 \times 10^3$ | 176 | 195 | 8.0 | 1.5/1 |
| C42 | | 1.4 | $5.0 \times 10^3$ | 228 | 109 | 1.0 | 3.5/1 |

TABLE 6

| Coating liquid for conductive layer | Metallic oxide particle (P) Kind | Water content [% by mass] | Powder resistivity [Ω · cm] | Amount [parts] | Binder material (B) (phenol resin) Amount [parts] (resin solid content is 60% by mass of amount below) | Dispersion time [h] | P/B in coating liquid for conductive layer |
|---|---|---|---|---|---|---|---|
| C43 | Tin oxide particle | 1.0 | $5.0 \times 10^3$ | 176 | 195 | 4.5 | 1.5/1 |
| C44 | doped with | 2.0 | $5.0 \times 10^3$ | 176 | 195 | 4.5 | 1.5/1 |
| C45 | phosphorus (average | 1.0 | $5.0 \times 10^3$ | 228 | 109 | 4.5 | 3.5/1 |
| C46 | primary particle diameter of 230 nm) | 2.0 | $5.0 \times 10^3$ | 228 | 109 | 4.5 | 3.5/1 |
| C47 | Barium sulfate | 1.0 | $5.0 \times 10^3$ | 176 | 195 | 4.5 | 1.5/1 |
| C48 | particle coated | 2.0 | $5.0 \times 10^3$ | 176 | 195 | 4.5 | 1.5/1 |
| C49 | with tin oxide | 1.0 | $5.0 \times 10^3$ | 228 | 109 | 4.5 | 3.5/1 |
| C50 | doped with phosphorus (average primary particle diameter of 230 nm) | 2.0 | $5.0 \times 10^3$ | 228 | 109 | 4.5 | 3.5/1 |
| C51 | Titanium oxide | 1.0 | $5.0 \times 10^3$ | 176 | 195 | 4.5 | 1.5/1 |
| C52 | particle coated | 2.0 | $5.0 \times 10^3$ | 176 | 195 | 4.5 | 1.5/1 |

TABLE 6-continued

| Coating liquid for conductive layer | Metallic oxide particle (P) Kind | Water content [% by mass] | Powder resistivity [Ω · cm] | Amount [parts] | Binder material (B) (phenol resin) Amount [parts] (resin solid content is 60% by mass of amount below) | Dispersion time [h] | P/B in coating liquid for conductive layer |
|---|---|---|---|---|---|---|---|
| C53 | with oxygen- | 1.0 | $5.0 \times 10^3$ | 228 | 109 | 4.5 | 3.5/1 |
| C54 | defective tin oxide (average primary particle diameter of 230 nm) | 2.0 | $5.0 \times 10^3$ | 228 | 109 | 4.5 | 3.5/1 |
| C55 | Titanium oxide | 1.0 | $5.0 \times 10^3$ | 176 | 195 | 4.5 | 1.5/1 |
| C56 | particle coated | 2.0 | $5.0 \times 10^3$ | 176 | 195 | 4.5 | 1.5/1 |
| C57 | with tin oxide | 1.0 | $5.0 \times 10^3$ | 228 | 109 | 4.5 | 3.5/1 |
| C58 | doped with antimony (average primary particle diameter of 230 nm) | 2.0 | $5.0 \times 10^3$ | 228 | 109 | 4.5 | 3.5/1 |
| C59 | Alumina particle | 1.0 | $>1.0 \times 10^7$ | 176 | 195 | 4.5 | 1.5/1 |
| C60 | (average | 2.0 | $>1.0 \times 10^7$ | 176 | 195 | 4.5 | 1.5/1 |
| C61 | primary particle | 1.0 | $>1.0 \times 10^7$ | 228 | 109 | 4.5 | 3.5/1 |
| C62 | diameter of 500 nm) | 2.0 | $>1.0 \times 10^7$ | 228 | 109 | 4.5 | 3.5/1 |

TABLE 7

| Coating liquid for conductive layer | Metallic oxide particle (P) Kind | Water content [% by mass] | Powder resistivity [Ω · cm] | Amount [parts] | Binder material (B) (phenol resin) Amount [parts] (resin solid content is 60% by mass of amount below) | Dispersion time [h] | P/B in coating liquid for conductive layer |
|---|---|---|---|---|---|---|---|
| C63 | Titanium oxide particle coated with tin oxide doped with phosphorus and used in coating liquid for conductive layer 1 described in Japanese Patent Application Laid-Open No. 2012-18371 | 0.80 | $4.0 \times 10^1$ | 207 | 144 | 4.5 | 2.4/1 |
| C64 | Titanium oxide particle coated with tin oxide doped with phosphorus and used in coating liquid for conductive layer 4 described in Japanese Patent Application Laid-Open No. 2012-18371 | 0.80 | $5.0 \times 10^2$ | 207 | 144 | 4.5 | 2.4/1 |
| C65 | Titanium oxide particle coated with tin oxide doped with tungsten and used in coating liquid for conductive layer 10 described in Japanese Patent Application Laid-Open No. 2012-18371 | 0.80 | $2.5 \times 10^1$ | 207 | 144 | 4.5 | 2.4/1 |
| C66 | Titanium oxide particle coated with tin oxide doped with tungsten and used in coating liquid for conductive layer 13 described in Japanese | 0.80 | $6.9 \times 10^1$ | 207 | 144 | 4.5 | 2.4/1 |

TABLE 7-continued

| Coating liquid for conductive layer | Metallic oxide particle (P) Kind | Water content [% by mass] | Powder resistivity [Ω · cm] | Amount [parts] | Binder material (B) (phenol resin) Amount [parts] (resin solid content is 60% by mass of amount below) | Dispersion time [h] | P/B in coating liquid for conductive layer |
|---|---|---|---|---|---|---|---|
| C67 | Patent Application Laid-Open No. 2012-18371 Titanium oxide particle coated with tin oxide doped with phosphorus and used in coating liquid for conductive layer L-7 described in Japanese Patent Application Laid-Open No. 2012-18370 | 0.80 | $1.0 \times 10^2$ | 207 | 144 | 4.5 | 2.4/1 |

TABLE 8

| Coating liquid for conductive layer | Metallic oxide particle (P) Kind | Water content [% by mass] | Powder resistivity [Ω · cm] | Amount [parts] | Binder material (B) (phenol resin) Amount [parts] (resin solid content is 60% by mass of amount below) | Dispersion time [h] | P/B in coating liquid for conductive layer |
|---|---|---|---|---|---|---|---|
| C68 | Titanium oxide particle coated with tin oxide doped with phosphorus and used in coating liquid for conductive layer L-21 described in Japanese Patent Application Laid-Open No. 2012-18370 | 0.80 | $5.0 \times 10^2$ | 207 | 144 | 4.5 | 2.4/1 |
| C69 | Titanium oxide particle coated with tin oxide doped with tungsten and used in coating liquid for conductive layer L-10 described in Japanese Patent Application Laid-Open No. 2012-18370 | 0.80 | $1.5 \times 10^2$ | 207 | 144 | 4.5 | 2.4/1 |
| C70 | Titanium oxide particle coated with tin oxide doped with tungsten and used in coating liquid for conductive layer L-22 described in Japanese Patent Application Laid-Open No. 2012-18370 | 0.80 | $5.5 \times 10^2$ | 207 | 144 | 4.5 | 2.4/1 |
| C71 | Titanium oxide particle coated with tin oxide doped with fluorine and used in coating liquid for conductive layer L-30 described in Japanese Patent Application Laid-Open No. 2012-18370 | 0.80 | $3.0 \times 10^2$ | 207 | 144 | 4.5 | 2.4/1 |
| C72 | Titanium oxide particle (average primary particle diameter of 200 nm) | 1.0 | $>1.0 \times 10^7$ | 176 | 195 | 4.5 | 1.5/1 |
| C73 | | 2.0 | $>1.0 \times 10^7$ | 176 | 195 | 4.5 | 1.5/1 |
| C74 | | 1.0 | $>1.0 \times 10^7$ | 228 | 109 | 4.5 | 3.5/1 |
| C75 | | 2.0 | $>1.0 \times 10^7$ | 228 | 109 | 4.5 | 3.5/1 |

<Production Examples of Electrophotographic Photosensitive Member>

(Production Example of Electrophotographic Photosensitive Member 1)

A support was an aluminum cylinder having a length of 246 mm and a diameter of 24 mm and produced by a production method including extrusion and drawing (JIS-A3003, aluminum alloy).

Under an environment of normal temperature and normal humidity (23° C./50% RH), the coating liquid for a conductive layer 1 was applied onto the support by dip coating, and the obtained coating film is dried and thermally cured for 30 minutes at 150° C. to form a conductive layer having a film thickness of 30 μm. The volume resistivity of the conductive layer was measured by the method described above, and it was $1.0\times10^{10}$ Ω·cm.

Next, 4.5 parts of N-methoxymethylated nylon (trade name: TORESIN EF-30T, made by Nagase ChemteX Corporation) and 1.5 parts of a copolymerized nylon resin (trade name: AMILAN CM8000, made by Toray Industries, Inc.) were dissolved in a mixed solvent of 65 parts of methanol/30 parts of n-butanol to prepare a coating solution for an undercoat layer. The coating solution for an undercoat layer was applied onto the conductive layer by dip coating, and the obtained coating film is dried for 6 minutes at 70° C. to form an undercoat layer having a film thickness of 0.85 μm.

Next, 10 parts of crystalline hydroxy gallium phthalocyanine crystals (charge-generating substance) having strong peaks at Bragg angles (2θ±0.2°) of 7.5°, 9.9°, 16.3°, 18.6°, 25.1°, and 28.3° in CuKα properties X ray diffraction, 5 parts of polyvinyl butyral (trade name: S-LECBX-1, made by Sekisui Chemical Co., Ltd.), and 250 parts of cyclohexanone were placed in a sand mill using glass beads having a diameter of 0.8 mm. The solution was dispersed under a condition: dispersing time, 3 hours. Next, 250 parts of ethyl acetate was added to the solution to prepare a coating solution for a charge-generating layer. The coating solution for a charge-generating layer was applied onto the undercoat layer by dip coating, and the obtained coating film is dried for 10 minutes at 100° C. to form a charge-generating layer having a film thickness of 0.15 μm.

Next, 5.6 parts of an amine compound (charge transport substance) represented by the following formula (CT-1):

(CT-1)

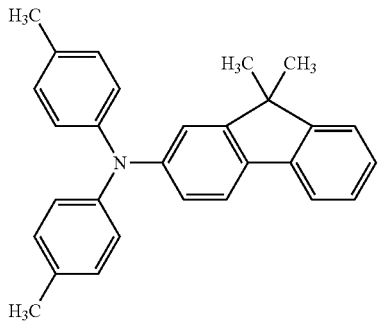

2.4 parts of an amine compound (charge transport substance) represented by the following formula (CT-2):

(CT-2)

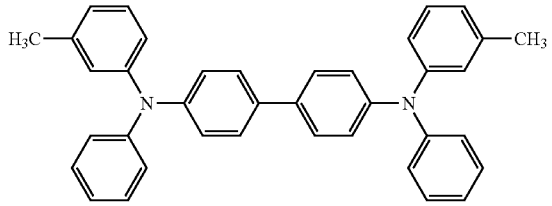

10 parts of a bisphenol Z type polycarbonate (trade name: 2200, made by Mitsubishi Engineering-Plastics Corporation), and 0.36 parts of siloxane-modified polycarbonate ((B-1):(B-2)=95:5 (molar ratio)) having the repeating structural unit represented by the following formula (B-1), the repeating structural unit represented by the following formula (B-2), and the terminal structure represented by the following formula (B-3):

(B-1)

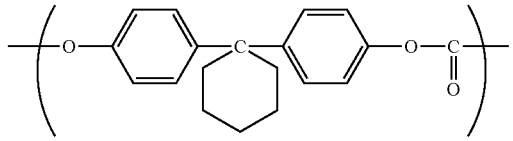

(B-2)

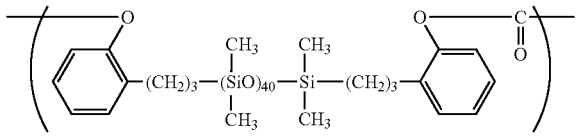

(B-3)

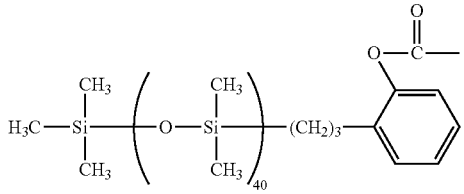

were dissolved in a mixed solvent of 60 parts of o-xylene/40 parts of dimethoxymethane/2.7 parts of methyl benzoate to prepare a coating solution for a charge transport layer. The coating solution for a charge transport layer was applied onto the charge-generating layer by dip coating, and the obtained coating film is dried for 30 minutes at 120° C. to form a charge transport layer having a film thickness of 7.0 μm. Thus, an electrophotographic photosensitive member 1 having charge transport layer as the surface layer was produced.

(Production Examples of Electrophotographic Photosensitive Members 2 to 60 and C1 to C75)

Electrophotographic photosensitive members 2 to 60 and C1 to C75 having charge transport layer as the surface layer were produced by the same operation as that in Production Example of the electrophotographic photosensitive member 1 except that the coating liquid for a conductive layer used in production of the electrophotographic photosensitive member 1 was changed from the coating liquid for a conductive layer 1 to the coating liquids for a conductive layer 2 to 60 and C1 to C75, respectively. The volume resistivity of a conductive layer in the electrophotographic photosensitive members 2 to 60 and C1 to C75 was measured by the same method as that in the case of the conductive layer of the electrophotographic photosensitive member 1. The result is shown in Tables 9 and 10. In the electrophotographic photosensitive members 1 to 60 and C1 to C75, the surface of the conductive layer was observed with an optical microscope in measurement of the volume resistivity of the conductive layer. Occurrence of cracks was found in the conductive layers of the electrophotographic photosensitive members C11, C12, C25, C26, C39, and C40.

TABLE 9

| Electrophotographic photosensitive member | Coating liquid for conductive layer | Volume resistivity of conductive layer [Ω · cm] | Cracks in conductive layer |
|---|---|---|---|
| 1 | 1 | $1.0 \times 10^{10}$ | No |
| 2 | 2 | $1.0 \times 10^{10}$ | No |
| 3 | 3 | $1.0 \times 10^{10}$ | No |
| 4 | 4 | $1.0 \times 10^{10}$ | No |
| 5 | 5 | $1.0 \times 10^{10}$ | No |
| 6 | 6 | $1.0 \times 10^{10}$ | No |
| 7 | 7 | $1.0 \times 10^{10}$ | No |
| 8 | 8 | $1.0 \times 10^{10}$ | No |
| 9 | 9 | $1.0 \times 10^{11}$ | No |
| 10 | 10 | $1.0 \times 10^{11}$ | No |
| 11 | 11 | $1.0 \times 10^{11}$ | No |
| 12 | 12 | $1.0 \times 10^{9}$ | No |
| 13 | 13 | $1.0 \times 10^{9}$ | No |
| 14 | 14 | $1.0 \times 10^{9}$ | No |
| 15 | 15 | $5.0 \times 10^{12}$ | No |
| 16 | 16 | $1.0 \times 10^{8}$ | No |
| 17 | 17 | $5.0 \times 10^{8}$ | No |
| 18 | 18 | $1.0 \times 10^{9}$ | No |
| 19 | 19 | $1.0 \times 10^{11}$ | No |
| 20 | 20 | $5.0 \times 10^{11}$ | No |
| 21 | 21 | $1.0 \times 10^{10}$ | No |
| 22 | 22 | $1.0 \times 10^{10}$ | No |
| 23 | 23 | $1.0 \times 10^{10}$ | No |
| 24 | 24 | $1.0 \times 10^{10}$ | No |
| 25 | 25 | $1.0 \times 10^{10}$ | No |
| 26 | 26 | $1.0 \times 10^{10}$ | No |
| 27 | 27 | $1.0 \times 10^{10}$ | No |
| 28 | 28 | $1.0 \times 10^{10}$ | No |
| 29 | 29 | $1.0 \times 10^{11}$ | No |
| 30 | 30 | $1.0 \times 10^{11}$ | No |
| 31 | 31 | $1.0 \times 10^{11}$ | No |
| 32 | 32 | $1.0 \times 10^{9}$ | No |
| 33 | 33 | $1.0 \times 10^{9}$ | No |
| 34 | 34 | $1.0 \times 10^{9}$ | No |
| 35 | 35 | $5.0 \times 10^{12}$ | No |
| 36 | 36 | $1.0 \times 10^{8}$ | No |
| 37 | 37 | $5.0 \times 10^{8}$ | No |
| 38 | 38 | $1.0 \times 10^{9}$ | No |
| 39 | 39 | $1.0 \times 10^{11}$ | No |
| 40 | 40 | $5.0 \times 10^{11}$ | No |
| 41 | 41 | $1.0 \times 10^{10}$ | No |
| 42 | 42 | $1.0 \times 10^{10}$ | No |
| 43 | 43 | $1.0 \times 10^{10}$ | No |
| 44 | 44 | $1.0 \times 10^{10}$ | No |
| 45 | 45 | $1.0 \times 10^{10}$ | No |
| 46 | 46 | $1.0 \times 10^{10}$ | No |
| 47 | 47 | $1.0 \times 10^{10}$ | No |
| 48 | 48 | $1.0 \times 10^{10}$ | No |
| 49 | 49 | $1.0 \times 10^{11}$ | No |
| 50 | 50 | $1.0 \times 10^{11}$ | No |
| 51 | 51 | $1.0 \times 10^{11}$ | No |
| 52 | 52 | $1.0 \times 10^{9}$ | No |
| 53 | 53 | $1.0 \times 10^{9}$ | No |
| 54 | 54 | $1.0 \times 10^{9}$ | No |
| 55 | 55 | $5.0 \times 10^{12}$ | No |
| 56 | 56 | $1.0 \times 10^{8}$ | No |
| 57 | 57 | $5.0 \times 10^{8}$ | No |
| 58 | 58 | $1.0 \times 10^{9}$ | No |

TABLE 9-continued

| Electrophotographic photosensitive member | Coating liquid for conductive layer | Volume resistivity of conductive layer [Ω · cm] | Cracks in conductive layer |
|---|---|---|---|
| 59 | 59 | $1.0 \times 10^{11}$ | No |
| 60 | 60 | $5.0 \times 10^{11}$ | No |

TABLE 10

| Electrophotographic photosensitive member | Coating liquid for conductive layer | Volume resistivity of conductive layer [Ω · cm] | Cracks in conductive layer |
|---|---|---|---|
| C1 | C1 | $1.0 \times 10^{10}$ | No |
| C2 | C2 | $1.0 \times 10^{10}$ | No |
| C3 | C3 | $1.0 \times 10^{10}$ | No |
| C4 | C4 | $1.0 \times 10^{10}$ | No |
| C5 | C5 | $1.0 \times 10^{11}$ | No |
| C6 | C6 | $1.0 \times 10^{11}$ | No |
| C7 | C7 | $1.0 \times 10^{9}$ | No |
| C8 | C8 | $1.0 \times 10^{9}$ | No |
| C9 | C9 | $5.0 \times 10^{11}$ | No |
| C10 | C10 | $5.0 \times 10^{11}$ | No |
| C11 | C11 | $5.0 \times 10^{8}$ | Yes |
| C12 | C12 | $5.0 \times 10^{8}$ | Yes |
| C13 | C13 | $1.0 \times 10^{13}$ | No |
| C14 | C14 | $5.0 \times 10^{7}$ | No |
| C15 | C15 | $1.0 \times 10^{10}$ | No |
| C16 | C16 | $1.0 \times 10^{10}$ | No |
| C17 | C17 | $1.0 \times 10^{10}$ | No |
| C18 | C18 | $1.0 \times 10^{10}$ | No |
| C19 | C19 | $1.0 \times 10^{11}$ | No |
| C20 | C20 | $1.0 \times 10^{11}$ | No |
| C21 | C21 | $1.0 \times 10^{9}$ | No |
| C22 | C22 | $1.0 \times 10^{9}$ | No |
| C23 | C23 | $5.0 \times 10^{11}$ | No |
| C24 | C24 | $5.0 \times 10^{11}$ | No |
| C25 | C25 | $5.0 \times 10^{8}$ | Yes |
| C26 | C26 | $5.0 \times 10^{8}$ | Yes |
| C27 | C27 | $1.0 \times 10^{13}$ | No |
| C28 | C28 | $5.0 \times 10^{7}$ | No |
| C29 | C29 | $1.0 \times 10^{10}$ | No |
| C30 | C30 | $1.0 \times 10^{10}$ | No |
| C31 | C31 | $1.0 \times 10^{10}$ | No |
| C32 | C32 | $1.0 \times 10^{10}$ | No |
| C33 | C33 | $1.0 \times 10^{11}$ | No |
| C34 | C34 | $1.0 \times 10^{11}$ | No |
| C35 | C35 | $1.0 \times 10^{9}$ | No |
| C36 | C36 | $1.0 \times 10^{9}$ | No |
| C37 | C37 | $5.0 \times 10^{11}$ | No |
| C38 | C38 | $5.0 \times 10^{11}$ | No |
| C39 | C39 | $5.0 \times 10^{8}$ | Yes |
| C40 | C40 | $5.0 \times 10^{8}$ | Yes |
| C41 | C41 | $1.0 \times 10^{13}$ | No |
| C42 | C42 | $5.0 \times 10^{7}$ | No |
| C43 | C43 | $1.0 \times 10^{11}$ | No |
| C44 | C44 | $1.0 \times 10^{11}$ | No |
| C45 | C45 | $1.0 \times 10^{9}$ | No |
| C46 | C46 | $1.0 \times 10^{9}$ | No |
| C47 | C47 | $1.0 \times 10^{11}$ | No |
| C48 | C48 | $1.0 \times 10^{11}$ | No |
| C49 | C49 | $1.0 \times 10^{9}$ | No |
| C50 | C50 | $1.0 \times 10^{9}$ | No |
| C51 | C51 | $1.0 \times 10^{11}$ | No |
| C52 | C52 | $1.0 \times 10^{11}$ | No |
| C53 | C53 | $1.0 \times 10^{9}$ | No |
| C54 | C54 | $1.0 \times 10^{9}$ | No |
| C55 | C55 | $1.0 \times 10^{11}$ | No |
| C56 | C56 | $1.0 \times 10^{11}$ | No |
| C57 | C57 | $1.0 \times 10^{9}$ | No |
| C58 | C58 | $1.0 \times 10^{9}$ | No |
| C59 | C59 | $1.0 \times 10^{12}$ | No |
| C60 | C60 | $1.0 \times 10^{12}$ | No |

TABLE 10-continued

| Electrophotographic photosensitive member | Coating liquid for conductive layer | Volume resistivity of conductive layer [Ω · cm] | Cracks in conductive layer |
|---|---|---|---|
| C61 | C61 | $1.0 \times 10^{10}$ | No |
| C62 | C62 | $1.0 \times 10^{10}$ | No |
| C63 | C63 | $2.0 \times 10^{8}$ | No |
| C64 | C64 | $1.0 \times 10^{9}$ | No |
| C65 | C65 | $1.0 \times 10^{8}$ | No |
| C66 | C66 | $3.0 \times 10^{8}$ | No |
| C67 | C67 | $5.0 \times 10^{8}$ | No |
| C68 | C68 | $1.0 \times 10^{9}$ | No |
| C69 | C69 | $6.0 \times 10^{8}$ | No |
| C70 | C70 | $2.0 \times 10^{9}$ | No |
| C71 | C71 | $8.0 \times 10^{8}$ | No |
| C72 | C72 | $1.0 \times 10^{12}$ | No |
| C73 | C73 | $1.0 \times 10^{12}$ | No |
| C74 | C74 | $1.0 \times 10^{10}$ | No |
| C75 | C75 | $1.0 \times 10^{10}$ | No |

Examples 1 to 60, and Comparative Examples 1 to 75

Each of the electrophotographic photosensitive members 1 to 60 and C1 to C75 was mounted on a laser beam printer (trade name: HP Laserjet P1505) made by Hewlett-Packard Company, and a sheet feeding durability test was performed under a low temperature and low humidity environment (15° C./10% RH) to evaluate an output image. In the sheet feeding durability test, a text image having a coverage rate of 2% was printed on a letter size sheet one by one in an intermittent mode, and 3000 sheets of the image were output.

Then, a sheet of a sample for image evaluation (halftone image of one dot KEIMA pattern) was output every time when the sheet feeding durability test was started, when 1500 sheets of the image were output, and when 3000 sheets of the image were output.

The criterion for evaluation of the image is as follows. The results are shown in Tables 11 to 14.

A: no poor image caused by occurrence of leakage is found in the image.

B: small black dots caused by occurrence of leakage are slightly found in the image.

C: large black dots caused by occurrence of leakage are clearly found in the image.

D: large black dots and short horizontal black streaks caused by occurrence of leakage are found in the image.

E: long horizontal black streaks caused by occurrence of leakage are found in the image.

When the sheet feeding durability test was started and after a sample for image evaluation was output after completing output of 3000 sheets of the image, the charge potential (dark potential) and the potential in exposure (bright potential) were measured. The measurement of the potential was performed using one white solid image and one black solid image. The dark potential at the initial stage (when the sheet feeding durability test was started) was Vd, and the bright potential at the initial stage (when the sheet feeding durability test was started) was Vl. The dark potential after 3000 sheets of the image were output was Vd', and the bright potential after 3000 sheets of the image were output was Vl'. The difference between the dark potential Vd' after 3000 sheets of the image were output and the dark potential Vd at the initial stage, i.e., the amount of the dark potential to be changed ΔVd (=|Vd'|−|Vd|) was determined. Moreover, the difference between the bright potential Vl' after 3000 sheets of the image were output and the bright potential Vl at the initial stage, i.e., the amount of the bright potential to be changed ΔVl (=|Vl'|−|Vl|) was determined. The result is shown in Tables 11 to 14.

Further, separated from the electrophotographic photosensitive members 1 to 60 and C1 to C75 used in the sheet feeding durability test, another set of the electrophotographic photosensitive members 1 to 60 and C1 to C75 were prepared, and preserved under a severe environment (high temperature and high humidity environment: 40° C./90% RH) for 30 days. Subsequently, each of the electrophotographic photosensitive members was mounted on a laser beam printer made by Hewlett-Packard Company (trade name: HP Laserjet P1505), and subjected to the sheet feeding durability test under a low temperature and low humidity environment (15° C./10% RH). The output image was evaluated. In the sheet feeding durability test, a text image having a coverage rate of 2% was printed on a letter size sheet one by one in an intermittent mode, and 3000 sheets of the image were output.

Figure 5:
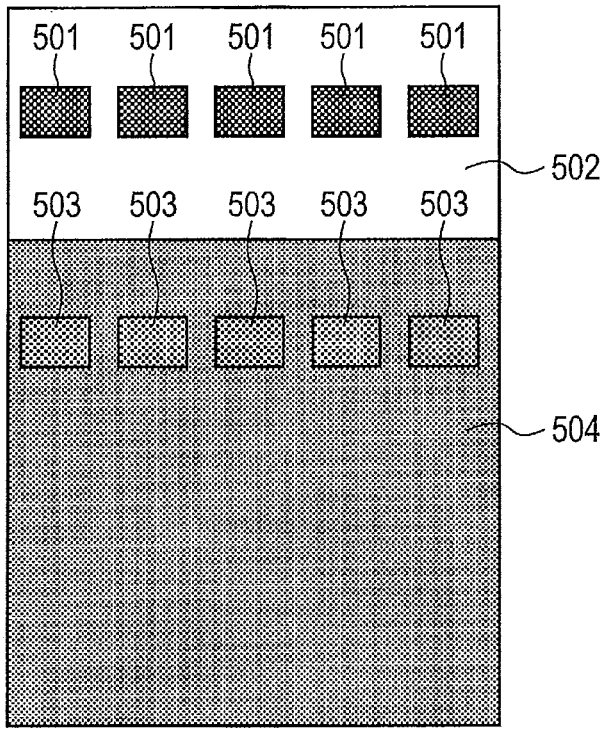
FIG. 5 is a drawing illustrating a sample for evaluation of ghost used in evaluation of ghost in Examples and Comparative Examples.
Figure 6:
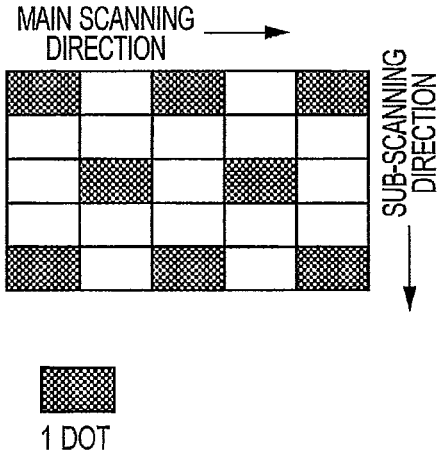
FIG. 6 is a drawing for illustrating a one dot KEIMA pattern image.

Then, a sample for evaluation of ghost illustrated in FIG. 5 was output every time when the sheet feeding durability test was started, when 1500 sheets of the image were output, and when 3000 sheets of the image were output. In FIG. 5, a black solid portion 501 (solid image), a white portion 502 (white image), a portion 503 in which ghost can be found (ghost), and a halftone portion 504 (one dot KEIMA pattern image) are illustrated. The one dot KEIMA pattern image is a halftone image having a pattern illustrated in FIG. 6.

The criterion for evaluation of ghost is as follows. The results are shown in Tables 11 to 14.

A: ghost is hardly found in the image (Macbeth concentration difference is less than 0.02).

B: ghost is slightly found in the image (Macbeth concentration difference is not less than 0.02 and less than 0.04).

C: ghost is somewhat found in the image (Macbeth concentration difference is not less than 0.04 and less than 0.06).

D: ghost is clearly found in the image (Macbeth concentration difference is not less than 0.06).

The ghosts produced in this evaluation all were the so-called positive ghost in which the concentration of the ghost portion is higher than the concentration of the halftone portion in the one dot KEIMA pattern image nearby. The Macbeth concentration difference means the difference in the concentration between the portion 503 in which ghost can be found and the halftone portion 504 (concentration of portion 503 in which ghost can be found (Macbeth concentration)−concentration of halftone portion 504 (Macbeth concentration)). The Macbeth concentration was measured using a spectrodensitometer (trade name: X-Rite 504/508, made by X-Rite, Incorporated). The Macbeth concentration was measured at five places in the portion 503 in which ghost can be found to obtain five Macbeth concentration differences. The average value thereof was defined as the Macbeth concentration difference in the sample for evaluation of ghost. A larger Macbeth concentration difference means a larger degree of the ghost.

TABLE 11

| Example | Electrophotographic photosensitive member | Leakage: When sheet feeding durability test is started | Leakage: When 1500 sheets of image are output | Leakage: When 3000 sheets of image are output | Amount of potential to be changed [V] ΔVd | Amount of potential to be changed [V] ΔVl | Ghost after preservation in severe condition: When sheet feeding durability test is started | Ghost after preservation in severe condition: When 1500 sheets of image are output | Ghost after preservation in severe condition: When 3000 sheets of image are output |
|---|---|---|---|---|---|---|---|---|---|
| 1 | 1 | A | A | A | +12 | +18 | A | A | B |
| 2 | 2 | A | A | B | +10 | +17 | A | A | A |
| 3 | 3 | A | A | A | +12 | +18 | A | A | B |
| 4 | 4 | A | A | A | +12 | +18 | A | A | B |
| 5 | 5 | A | A | B | +10 | +17 | A | A | A |
| 6 | 6 | A | A | A | +12 | +18 | A | A | B |
| 7 | 7 | A | A | A | +12 | +18 | A | A | B |
| 8 | 8 | A | A | A | +12 | +20 | A | B | B |
| 9 | 9 | A | A | B | +10 | +17 | A | A | A |
| 10 | 10 | A | A | A | +11 | +18 | A | A | B |
| 11 | 11 | A | A | A | +12 | +20 | A | B | B |
| 12 | 12 | A | A | B | +10 | +17 | A | A | A |
| 13 | 13 | A | A | A | +12 | +18 | A | A | B |
| 14 | 14 | A | A | A | +12 | +20 | A | B | B |
| 15 | 15 | A | A | A | +12 | +18 | A | A | B |
| 16 | 16 | A | A | A | +12 | +18 | A | A | B |
| 17 | 17 | A | A | A | +11 | +16 | A | A | B |
| 18 | 18 | A | A | A | +11 | +17 | A | A | B |
| 19 | 19 | A | A | A | +12 | +20 | A | A | B |
| 20 | 20 | A | A | A | +12 | +20 | A | A | B |
| 21 | 21 | A | A | B | +12 | +20 | A | A | B |
| 22 | 22 | A | B | B | +10 | +19 | A | A | A |
| 23 | 23 | A | A | B | +12 | +20 | A | A | B |
| 24 | 24 | A | A | B | +12 | +20 | A | A | B |
| 25 | 25 | A | B | B | +10 | +19 | A | A | A |
| 26 | 26 | A | A | B | +12 | +20 | A | A | B |
| 27 | 27 | A | A | B | +12 | +20 | A | A | B |
| 28 | 28 | A | A | B | +12 | +22 | A | B | B |
| 29 | 29 | A | B | B | +10 | +19 | A | A | A |
| 30 | 30 | A | A | B | +11 | +20 | A | A | B |

TABLE 12

| Example | Electrophotographic photosensitive member | Leakage: When sheet feeding durability test is started | Leakage: When 1500 sheets of image are output | Leakage: When 3000 sheets of image are output | Amount of potential to be changed [V] ΔVd | Amount of potential to be changed [V] ΔVl | Ghost after preservation in severe condition: When sheet feeding durability test is started | Ghost after preservation in severe condition: When 1500 sheets of image are output | Ghost after preservation in severe condition: When 3000 sheets of image are output |
|---|---|---|---|---|---|---|---|---|---|
| 31 | 31 | A | A | B | +12 | +22 | A | B | B |
| 32 | 32 | A | B | B | +10 | +19 | A | A | A |
| 33 | 33 | A | A | B | +12 | +20 | A | A | B |
| 34 | 34 | A | A | B | +12 | +22 | A | B | B |
| 35 | 35 | A | A | B | +12 | +20 | A | A | B |
| 36 | 36 | A | A | B | +12 | +20 | A | A | B |
| 37 | 37 | A | A | B | +11 | +18 | A | A | B |
| 38 | 38 | A | A | B | +11 | +19 | A | A | B |
| 39 | 39 | A | A | B | +12 | +22 | A | A | B |
| 40 | 40 | A | A | B | +12 | +22 | A | A | B |
| 41 | 41 | A | A | B | +14 | +22 | A | A | B |
| 42 | 42 | A | B | B | +12 | +21 | A | A | A |
| 43 | 43 | A | B | B | +14 | +22 | A | A | B |
| 44 | 44 | A | A | B | +14 | +22 | A | A | B |
| 45 | 45 | A | B | B | +12 | +21 | A | A | A |
| 46 | 46 | A | A | B | +14 | +22 | A | A | B |
| 47 | 47 | A | A | B | +14 | +22 | A | A | B |
| 48 | 48 | A | A | B | +14 | +24 | A | B | B |
| 49 | 49 | A | B | B | +12 | +21 | A | A | A |
| 50 | 50 | A | A | B | +13 | +22 | A | A | B |
| 51 | 51 | A | A | B | +14 | +24 | A | B | B |
| 52 | 52 | A | B | B | +12 | +21 | A | A | A |
| 53 | 53 | A | A | B | +14 | +22 | A | A | B |
| 54 | 54 | A | A | B | +14 | +24 | A | B | B |

TABLE 12-continued

| | | Leakage | | | | | Ghost after preservation in severe condition | | |
|---|---|---|---|---|---|---|---|---|---|
| Example | Electrophotographic photosensitive member | When sheet feeding durability test is started | When 1500 sheets of image are output | When 3000 sheets of image are output | Amount of potential to be changed [V] ΔVd | ΔVl | When sheet feeding durability test is started | When 1500 sheets of image are output | When 3000 sheets of image are output |
| 55 | 55 | A | A | B | +14 | +22 | A | A | B |
| 56 | 56 | A | B | B | +14 | +22 | A | A | B |
| 57 | 57 | A | B | B | +13 | +20 | A | A | B |
| 58 | 58 | A | B | B | +13 | +21 | A | A | B |
| 59 | 59 | A | A | B | +14 | +24 | A | A | B |
| 60 | 60 | A | A | B | +14 | +24 | A | A | B |

TABLE 13

| | | Leakage | | | | | Ghost after preservation in severe condition | | |
|---|---|---|---|---|---|---|---|---|---|
| Comparative Example | Electrophotographic photosensitive member | When sheet feeding durability test is started | When 1500 sheets of image are output | When 3000 sheets of image are output | Amount of potential to be changed [V] ΔVd | ΔVl | When sheet feeding durability test is started | When 1500 sheets of image are output | When 3000 sheets of image are output |
| 1 | C1 | B | B | C | +10 | +17 | A | A | A |
| 2 | C2 | B | B | B | +10 | +17 | A | A | A |
| 3 | C3 | A | A | A | +12 | +25 | B | B | B |
| 4 | C4 | A | A | A | +12 | +30 | C | C | C |
| 5 | C5 | B | B | B | +10 | +17 | A | A | A |
| 6 | C6 | A | A | A | +12 | +25 | B | B | B |
| 7 | C7 | B | B | B | +10 | +17 | A | A | A |
| 8 | C8 | A | A | A | +12 | +25 | B | B | B |
| 9 | C9 | A | B | B | +12 | +35 | B | B | B |
| 10 | C10 | A | A | A | +12 | +35 | C | C | C |
| 11 | C11 | E | E | E | +10 | +17 | A | A | A |
| 12 | C12 | D | D | D | +10 | +17 | A | B | B |
| 13 | C13 | A | A | A | +13 | +40 | B | B | B |
| 14 | C14 | B | B | C | +11 | +17 | A | A | B |
| 15 | C15 | B | C | C | +10 | +19 | A | A | A |
| 16 | C16 | B | B | C | +10 | +19 | A | A | A |
| 17 | C17 | A | A | B | +12 | +27 | B | B | B |
| 18 | C18 | A | A | B | +12 | +32 | C | C | C |
| 19 | C19 | B | B | C | +10 | +19 | A | A | A |
| 20 | C20 | A | A | B | +12 | +27 | B | B | B |
| 21 | C21 | B | B | C | +10 | +19 | A | A | A |
| 22 | C22 | A | A | B | +12 | +27 | B | B | B |
| 23 | C23 | B | B | B | +12 | +37 | B | B | B |
| 24 | C24 | A | A | B | +12 | +37 | C | C | C |
| 25 | C25 | E | E | E | +10 | +19 | A | A | A |
| 26 | C26 | D | D | E | +10 | +19 | A | B | B |
| 27 | C27 | A | A | B | +13 | +42 | B | B | B |
| 28 | C28 | B | C | C | +11 | +19 | A | A | B |
| 29 | C29 | C | C | C | +12 | +21 | A | A | A |
| 30 | C30 | B | C | C | +12 | +21 | A | A | A |
| 31 | C31 | A | B | B | +14 | +29 | B | B | B |
| 32 | C32 | A | B | B | +14 | +34 | C | C | C |
| 33 | C33 | B | C | C | +12 | +21 | A | A | A |
| 34 | C34 | A | B | B | +14 | +29 | B | B | B |
| 35 | C35 | B | C | C | +12 | +21 | A | A | A |
| 36 | C36 | A | B | B | +14 | +29 | B | B | B |

TABLE 14

| Comparative Example | Electrophotographic photosensitive member | Leakage: When sheet feeding durability test is started | Leakage: When 1500 sheets of image are output | Leakage: When 3000 sheets of image are output | Amount of potential to be changed [V] ΔVd | Amount of potential to be changed [V] ΔVl | Ghost after preservation in severe condition: When sheet feeding durability test is started | Ghost after preservation in severe condition: When 1500 sheets of image are output | Ghost after preservation in severe condition: When 3000 sheets of image are output |
|---|---|---|---|---|---|---|---|---|---|
| 37 | C37 | B | B | C | +14 | +39 | B | B | B |
| 38 | C38 | A | B | B | +14 | +39 | C | C | C |
| 39 | C39 | E | E | E | +12 | +21 | A | A | A |
| 40 | C40 | D | E | E | +12 | +21 | A | B | B |
| 41 | C41 | A | B | B | +15 | +44 | B | B | B |
| 42 | C42 | C | C | C | +13 | +21 | A | A | B |
| 43 | C43 | C | D | D | +10 | +19 | B | C | C |
| 44 | C44 | B | B | B | +14 | +35 | C | C | D |
| 45 | C45 | D | D | D | +11 | +18 | B | C | C |
| 46 | C46 | B | C | C | +13 | +30 | C | D | D |
| 47 | C47 | D | D | E | +10 | +18 | B | B | C |
| 48 | C48 | B | B | B | +14 | +34 | C | C | C |
| 49 | C49 | D | E | E | +11 | +17 | B | B | C |
| 50 | C50 | B | C | C | +13 | +29 | C | C | C |
| 51 | C51 | B | C | C | +10 | +17 | B | B | B |
| 52 | C52 | B | B | B | +12 | +25 | B | B | C |
| 53 | C53 | C | C | C | +10 | +17 | B | B | B |
| 54 | C54 | B | B | C | +12 | +25 | B | B | C |
| 55 | C55 | E | E | E | +10 | +17 | B | B | B |
| 56 | C56 | D | D | D | +11 | +18 | B | B | B |
| 57 | C57 | E | E | E | +10 | +17 | B | B | B |
| 58 | C58 | D | D | E | +11 | +18 | B | B | B |
| 59 | C59 | C | C | C | +15 | +45 | C | C | D |
| 60 | C60 | B | B | B | +16 | +50 | C | D | D |
| 61 | C61 | C | C | C | +15 | +44 | C | C | D |
| 62 | C62 | B | B | B | +16 | +49 | C | D | D |
| 63 | C63 | C | C | C | +11 | +17 | A | A | A |
| 64 | C64 | B | C | C | +11 | +18 | A | A | A |
| 65 | C65 | C | C | C | +11 | +17 | A | A | A |
| 66 | C66 | C | C | C | +11 | +17 | A | A | A |
| 67 | C67 | C | C | C | +11 | +17 | A | A | A |
| 68 | C68 | B | C | C | +11 | +18 | A | A | A |
| 69 | C69 | C | C | C | +11 | +17 | A | A | A |
| 70 | C70 | B | C | C | +11 | +18 | A | A | A |
| 71 | C71 | C | C | C | +13 | +20 | A | A | A |
| 72 | C72 | C | C | C | +15 | +45 | C | C | D |
| 73 | C73 | B | B | B | +16 | +50 | C | D | D |
| 74 | C74 | C | C | C | +15 | +44 | C | C | D |
| 75 | C75 | B | B | B | +16 | +49 | C | D | D |

(Production Example of Electrophotographic Photosensitive Member 61)

An electrophotographic photosensitive member 61 having charge transport layer as the surface layer was produced by the same operation as that in Production Example of the electrophotographic photosensitive member 1 except that the film thickness of the charge transport layer was changed from 7.0 μm to 4.5 μm.

(Production Examples of Electrophotographic Photosensitive Members 62 to 120 and C76 to C150)

Electrophotographic photosensitive members 62 to 120 and C76 to C150 having the charge transport layer as the surface layer were produced by the same operation as that in Production Example of the electrophotographic photosensitive member 61 except that the coating liquid for a conductive layer used in production of the electrophotographic photosensitive member 61 was changed from the coating liquid for a conductive layer 1 to each of coating liquids for a conductive layer 2 to 60 and C1 to C75.

Examples 61 to 120 and Comparative Examples 76 to 150

The electrophotographic photosensitive members 61 to 120 and C76 to C150 were subjected to a probe pressure resistance test as follows. The results are shown in Tables 15 and 16.

Figure 4:
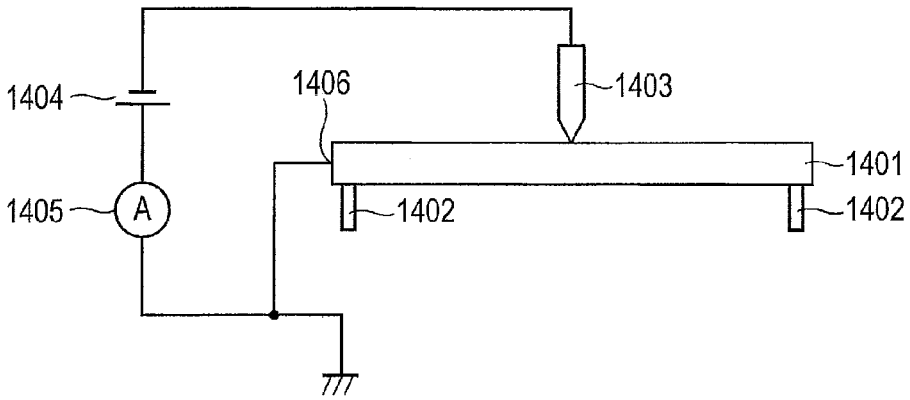
FIG. 4 is a drawing illustrating an example of a probe pressure resistance test apparatus.

In FIG. 4, a probe pressure resistance test apparatus is illustrated. The probe pressure resistance test was performed under a normal temperature and normal humidity environment (23° C./50% RH). Both ends of an electrophotographic photosensitive member 1401 for the test were disposed on fixing bases 1402, and fixed not to move. The tip of a probe electrode 1403 was contacted with the surface of the electrophotographic photosensitive member 1401. A power supply 1404 for applying voltage and an ammeter 1405 for measuring current were connected to the probe electrode 1403. A portion 1406 contacting the support in the electrophotographic photosensitive member 1401 was connected to a grounding terminal. The voltage to be applied from the probe electrode 1403 for 2 seconds was increased from 0 V by 10 V. The leakage occurred inside of the electrophotographic photosensitive member 1401 contacted by the tip of the probe electrode 1403, and the value measured by the ammeter 1405 started to become 10 times or more larger. The voltage at this time was defined as the probe pressure resistance value. The measurement was performed at five places of the surface of the electrophotographic photosensitive member 1401. The average value was defined as the probe pressure resistance value of the electrophotographic photosensitive member 1401 for the test.

TABLE 15

| Example | Electrophotographic photosensitive member | Probe pressure resistance value [−V] |
|---|---|---|
| 61 | 61 | 4900 |
| 62 | 62 | 4200 |
| 63 | 63 | 4600 |
| 64 | 64 | 4770 |
| 65 | 65 | 4100 |
| 66 | 66 | 4920 |
| 67 | 67 | 4940 |
| 68 | 68 | 4980 |
| 69 | 69 | 4150 |
| 70 | 70 | 4790 |
| 71 | 71 | 5000 |
| 72 | 72 | 4000 |
| 73 | 73 | 4760 |
| 74 | 74 | 4960 |
| 75 | 75 | 4820 |
| 76 | 76 | 4700 |
| 77 | 77 | 4650 |
| 78 | 78 | 4700 |
| 79 | 79 | 4860 |
| 80 | 80 | 4880 |
| 81 | 81 | 4880 |
| 82 | 82 | 4180 |
| 83 | 83 | 4580 |
| 84 | 84 | 4750 |
| 85 | 85 | 4080 |
| 86 | 86 | 4900 |
| 87 | 87 | 4920 |
| 88 | 88 | 4960 |
| 89 | 89 | 4130 |
| 90 | 90 | 4770 |
| 91 | 91 | 4980 |
| 92 | 92 | 3980 |
| 93 | 93 | 4740 |
| 94 | 94 | 4940 |
| 95 | 95 | 4800 |
| 96 | 96 | 4680 |
| 97 | 97 | 4630 |
| 98 | 98 | 4680 |
| 99 | 99 | 4840 |
| 100 | 100 | 4860 |
| 101 | 101 | 4860 |
| 102 | 102 | 4160 |
| 103 | 103 | 4560 |
| 104 | 104 | 4730 |
| 105 | 105 | 4060 |
| 106 | 106 | 4880 |
| 107 | 107 | 4900 |
| 108 | 108 | 4940 |
| 109 | 109 | 4110 |
| 110 | 110 | 4750 |
| 111 | 111 | 4960 |
| 112 | 112 | 3960 |
| 113 | 113 | 4720 |
| 114 | 114 | 4920 |
| 115 | 115 | 4780 |
| 116 | 116 | 4660 |
| 117 | 117 | 4610 |
| 118 | 118 | 4660 |
| 119 | 119 | 4820 |
| 120 | 120 | 4840 |

TABLE 16

| Comparative Example | Electrophotographic photosensitive member | Probe pressure resistance value [−V] |
|---|---|---|
| 76 | C76 | 2900 |
| 77 | C77 | 3100 |
| 78 | C78 | 4980 |
| 79 | C79 | 5000 |
| 80 | C80 | 3150 |
| 81 | C81 | 4990 |
| 82 | C82 | 3000 |
| 83 | C83 | 4960 |
| 84 | C84 | 4200 |
| 85 | C85 | 5000 |
| 86 | C86 | 2500 |
| 87 | C87 | 3000 |
| 88 | C88 | 4840 |
| 89 | C89 | 3760 |
| 90 | C90 | 2880 |
| 91 | C91 | 3080 |
| 92 | C92 | 4960 |
| 93 | C93 | 4980 |
| 94 | C94 | 3130 |
| 95 | C95 | 4970 |
| 96 | C96 | 2980 |
| 97 | C97 | 4940 |
| 98 | C98 | 4180 |
| 99 | C99 | 4980 |
| 100 | C100 | 2480 |
| 101 | C101 | 2980 |
| 102 | C102 | 4820 |
| 103 | C103 | 3740 |
| 104 | C104 | 2860 |
| 105 | C105 | 3060 |
| 106 | C106 | 4940 |
| 107 | C107 | 4960 |
| 108 | C108 | 3110 |
| 109 | C109 | 4950 |
| 110 | C110 | 2960 |
| 111 | C111 | 4920 |
| 112 | C112 | 4160 |
| 113 | C113 | 4960 |
| 114 | C114 | 2460 |
| 115 | C115 | 2960 |
| 116 | C116 | 4800 |
| 117 | C117 | 3720 |
| 118 | C118 | 3150 |
| 119 | C119 | 4500 |
| 120 | C120 | 3000 |
| 121 | C121 | 4460 |
| 122 | C122 | 3050 |
| 123 | C123 | 4400 |
| 124 | C124 | 2900 |
| 125 | C125 | 4360 |
| 126 | C126 | 3350 |
| 127 | C127 | 4700 |
| 128 | C128 | 3200 |
| 129 | C129 | 4660 |
| 130 | C130 | 2150 |
| 131 | C131 | 3000 |
| 132 | C132 | 2000 |
| 133 | C133 | 4360 |
| 134 | C134 | 3350 |
| 135 | C135 | 4700 |
| 136 | C136 | 3200 |
| 137 | C137 | 2960 |
| 138 | C138 | 2700 |
| 139 | C139 | 2800 |
| 140 | C140 | 2650 |
| 141 | C141 | 2750 |
| 142 | C142 | 2600 |
| 143 | C143 | 2800 |
| 144 | C144 | 2600 |
| 145 | C145 | 2800 |
| 146 | C146 | 2700 |
| 147 | C147 | 3350 |
| 148 | C148 | 4700 |
| 149 | C149 | 3200 |
| 150 | C150 | 2960 |

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Applications No. 2012-147143 filed on Jun. 29, 2012, and No. 2013-006397 filed on Jan. 17, 2013 which are hereby incorporated by reference herein in their entirety.

REFERENCE SIGNS LIST

1 electrophotographic photosensitive member
2 shaft
3 charging unit (primary charging unit)
4 exposure light (image exposure light)
5 developing unit
6 transferring unit (such as transfer roller)
7 cleaning unit (such as cleaning blade)
8 fixing unit
9 process cartridge
10 guide unit
11 pre-exposure light
P transfer material (such as paper)

The invention claimed is:

1. A method for producing an electrophotographic photosensitive member, comprising:

a step (i) of forming a conductive layer having a volume resistivity of not less than $1.0\times10^{8}$ Ω·cm and not more than $5.0\times10^{12}$ Ω·cm on a support; and a step (iii) of forming a photosensitive layer on the conductive layer, wherein the step (i) comprises:

preparing a metallic oxide particle having a water content of not less than 1.0% by mass and not more than 2.0% by mass, preparing a coating liquid for a conductive layer by mixing a solvent, a binder material, and the metallic oxide particle, and forming the conductive layer using the coating liquid for a conductive layer, wherein a mass ratio (PB) of the metallic oxide particle (P) to the binder material (B) in the coating liquid for a conductive layer is not less than 1.5/1.0 and not more than 3.5/1.0, and wherein the metallic oxide particle is selected from the group consisting of:

a titanium oxide particle coated with tin oxide doped with phosphorus, a titanium oxide particle coated with tin oxide doped with tungsten, and a titanium oxide particle coated with tin oxide doped with fluorine.

2. The method for producing an electrophotographic photosensitive member according to claim 1, wherein the metallic oxide particle has a water content of not less than 1.2% by mass and not more than 1.9% by mass.

3. The method for producing an electrophotographic photosensitive member according to claim 2, wherein the metallic oxide particle has a water content of not less than 1.3% by mass and not more than 1.6% by mass.

4. The method for producing an electrophotographic photosensitive member according to claim 1, wherein the metallic oxide particle is a titanium oxide particle coated with tin oxide doped with phosphorus.

5. The method for producing an electrophotographic photosensitive member according to claim 1, wherein the metallic oxide particle has a powder resistivity of not less than $1.0\times10^{1}$ Ω·cm and not more than $1.0\times10^{6}$ Ω·cm.

6. The method for producing an electrophotographic photosensitive member according to claim 5, wherein the metallic oxide particle has a powder resistivity of not less than $1.0\times10^{2}$ Ω·cm and not more than $1.0\times10^{5}$ Ω·cm.

7. The method for producing an electrophotographic photosensitive member according to claim 1, wherein the solvent is an alcohol.

8. The method for producing an electrophotographic photosensitive member according to claim 1, wherein the binder material is a monomer and/or an oligomer of a curable resin.

9. The method for producing an electrophotographic photosensitive member according to claim 8, wherein the curable resin is a phenol resin.

10. The method for producing an electrophotographic photosensitive member according to claim 1, wherein the conductive layer has a film thickness of not less than 10 μm and not more than 40 μm.

11. The method for producing an electrophotographic photosensitive member according to claim 10, wherein the conductive layer has a film thickness of not less than 15 μm and not more than 35 μm.

12. The method for producing an electrophotographic photosensitive member according to claim 1, wherein the method further comprises a step (ii) of forming an undercoat layer on the conductive layer between the steps (i) and (iii), and the step (iii) is a step of forming the photosensitive layer on the undercoat layer.

13. The method for producing an electrophotographic photosensitive member according to claim 1, wherein the step (iii) comprises:

forming a charge generation layer, and forming a charge transport layer on the charge generation layer.

* * * * *